US012185884B2

(12) United States Patent
Lang et al.

(10) Patent No.: US 12,185,884 B2
(45) Date of Patent: Jan. 7, 2025

(54) DISPENSER

(71) Applicant: Deb IP Limited, Derbyshire (GB)

(72) Inventors: Christopher James Lang, Nottinghamshire (GB); Dean Philip Limbert, Derbyshire (GB); James John May, Kenilworth (GB); Martin Crofton, Solihull (GB); Richard Brian Clough, Pedmore Stourbridge (GB); Robert Butler, Nottinghamshire (GB); Grace McAlpine Kane, Warwick (GB)

(73) Assignee: DEB IP LIMITED, Derbyshire (GB)

( * ) Notice: Subject to any disclaimer, the term of this patent is extended or adjusted under 35 U.S.C. 154(b) by 485 days.

(21) Appl. No.: 17/496,162

(22) Filed: Oct. 7, 2021

(65) Prior Publication Data

US 2023/0115251 A1 Apr. 13, 2023

(51) Int. Cl.
*A47K 5/12* (2006.01)
*B65D 83/00* (2006.01)

(52) U.S. Cl.
CPC ..... *A47K 5/1207* (2013.01); *A47K 5/1208* (2013.01); *B65D 83/0072* (2013.01)

(58) Field of Classification Search
CPC ..... A47K 5/1207
See application file for complete search history.

(56) References Cited

U.S. PATENT DOCUMENTS

| | | | | |
|---|---|---|---|---|
| 5,083,678 | A * | 1/1992 | Waring | B65D 1/0292 222/105 |
| 5,421,489 | A * | 6/1995 | Holzner, Sr. | A47K 5/1208 222/207 |
| 5,445,288 | A | 8/1995 | Banks | |
| 5,556,005 | A * | 9/1996 | Banks | A47K 5/1204 222/105 |
| 6,152,330 | A * | 11/2000 | Polan | A47K 5/1215 222/181.3 |
| 6,619,509 | B2 | 9/2003 | DeKoning et al. | |
| 6,729,502 | B2 | 5/2004 | Lewis et al. | |
| 6,729,503 | B2 | 5/2004 | DeKoning et al. | |
| 6,772,916 | B1 | 8/2004 | Reynolds | |
| 7,066,357 | B2 | 6/2006 | Ciavarella et al. | |
| 7,086,567 | B1 | 8/2006 | Ciavarella et al. | |
| 7,114,639 | B2 | 10/2006 | Lewis et al. | |
| 7,198,177 | B2 | 4/2007 | Ganzeboom | |
| 7,232,045 | B2 | 6/2007 | Ophardt et al. | |
| 7,278,554 | B2 | 10/2007 | Armstrong | |

(Continued)

FOREIGN PATENT DOCUMENTS

| | | |
|---|---|---|
| EP | 1345519 A1 | 9/2003 |
| EP | 1444049 B1 | 8/2007 |

(Continued)

*Primary Examiner* — Jeremy Carroll
(74) *Attorney, Agent, or Firm* — Quarles & Brady LLP

(57) ABSTRACT

A dispenser includes a front panel that can be opaque, and a body that includes a sidewall extending from a rear wall. Further, the front panel is coupled to the body and an interior cavity is formed therebetween. The sidewall includes an illuminating portion and a viewing portion. The illuminating portion is translucent and the viewing portion is transparent. The viewing portion is located between the front panel and the rear wall and the viewing portion and the illuminating portion indicate a refill status.

14 Claims, 14 Drawing Sheets

(56) References Cited

U.S. PATENT DOCUMENTS

| | | | | |
|---|---|---|---|---|
| 7,527,178 | B2 | 5/2009 | Lewis | |
| 7,611,033 | B2 | 11/2009 | Ganzeboom | |
| 7,984,829 | B2 | 7/2011 | Cittadino et al. | |
| 8,047,403 | B2 | 11/2011 | Quinlan et al. | |
| 8,047,404 | B2 | 11/2011 | Quinlan et al. | |
| 8,104,650 | B2 | 1/2012 | Lang et al. | |
| 8,201,707 | B2 | 6/2012 | Ophardt | |
| 8,215,523 | B2 | 7/2012 | Ophardt | |
| 8,261,950 | B2 | 9/2012 | Cittadino et al. | |
| 8,276,784 | B2 | 10/2012 | Ciavarella et al. | |
| 8,313,010 | B2 | 11/2012 | Quinlan et al. | |
| 8,336,740 | B1 | 12/2012 | Daansen | |
| 8,348,101 | B2 | 1/2013 | Ciavarella et al. | |
| 8,365,954 | B2 | 2/2013 | Ophardt et al. | |
| 8,387,830 | B2 | 3/2013 | Proper et al. | |
| 8,479,951 | B2 | 7/2013 | Ciavarella et al. | |
| 8,496,142 | B2 | 7/2013 | Uehira et al. | |
| 8,499,981 | B2 | 8/2013 | Quinlan et al. | |
| 8,528,787 | B2 | 9/2013 | Cittadino et al. | |
| 8,561,441 | B2 | 10/2013 | Herrmann et al. | |
| 8,561,847 | B2 | 10/2013 | Rosenkranz et al. | |
| 8,668,116 | B2 | 3/2014 | Ciavarella et al. | |
| 8,672,183 | B2 | 3/2014 | Ophardt et al. | |
| 8,672,187 | B2 | 3/2014 | Ophardt | |
| 8,684,236 | B2 | 4/2014 | Ophardt | |
| 8,733,596 | B2 | 5/2014 | Ophardt et al. | |
| 8,746,510 | B2 | 6/2014 | Cittadino et al. | |
| 8,807,398 | B2 | 8/2014 | Sundberg et al. | |
| 8,814,005 | B2 | 8/2014 | Banks et al. | |
| 8,820,585 | B1 | 9/2014 | Banks et al. | |
| 8,844,769 | B2 | 9/2014 | Rosenkranz et al. | |
| 8,851,331 | B2 | 10/2014 | Pelkey et al. | |
| 8,955,718 | B2 | 2/2015 | Ciavarella et al. | |
| 9,027,788 | B2 | 5/2015 | Ophardt et al. | |
| 9,027,790 | B2 | 5/2015 | Ciavarella et al. | |
| 9,038,862 | B2 | 5/2015 | McNulty et al. | |
| 9,073,066 | B2 | 7/2015 | Banks et al. | |
| 9,089,860 | B2 | 7/2015 | Quinlan et al. | |
| 9,105,203 | B2 | 8/2015 | Carlson et al. | |
| 9,149,161 | B2 | 10/2015 | Ophardt et al. | |
| 9,172,266 | B2 | 10/2015 | Curtis et al. | |
| 9,179,808 | B2 | 11/2015 | McNulty et al. | |
| 9,204,765 | B2 | 12/2015 | McNulty et al. | |
| 9,302,285 | B2 | 4/2016 | Marbet et al. | |
| 9,307,871 | B2 | 4/2016 | McNulty et al. | |
| 9,340,337 | B2 | 5/2016 | Pelkey et al. | |
| 9,522,773 | B2 | 12/2016 | Tom et al. | |
| 9,539,598 | B2 | 1/2017 | Ciavarella et al. | |
| 9,611,839 | B2 | 4/2017 | McNulty et al. | |
| 9,616,445 | B2 | 4/2017 | Ciavarella et al. | |
| 9,682,390 | B2 | 6/2017 | Ophardt et al. | |
| 9,700,181 | B1 | 7/2017 | Santoro et al. | |
| 9,750,377 | B2 | 9/2017 | Bai | |
| 9,854,947 | B2 | 1/2018 | McNulty et al. | |
| 9,936,841 | B2 | 4/2018 | Ophardt et al. | |
| 10,034,583 | B2 | 7/2018 | Carignan et al. | |
| 10,034,585 | B2 | 7/2018 | Moore et al. | |
| 10,149,575 | B2 | 12/2018 | Tojek et al. | |
| 10,242,301 | B2 | 3/2019 | Ophardt et al. | |
| 10,485,385 | B2 | 11/2019 | Tojek et al. | |
| 10,660,983 | B2 | 5/2020 | Jennings | |
| 10,671,902 | B2 | 6/2020 | Ophardt et al. | |
| 10,765,620 | B2 | 9/2020 | Fedyna | |
| 2006/0273102 | A1* | 12/2006 | Wieser | A47K 10/422 221/56 |
| 2008/0257906 | A1* | 10/2008 | Orgna | A47K 5/1202 221/303 |
| 2012/0211520 | A1* | 8/2012 | Ciavarella | A47K 5/122 222/92 |
| 2017/0337458 | A1* | 11/2017 | Ophardt | A47K 5/1202 |
| 2018/0009565 | A1 | 1/2018 | Carlson et al. | |
| 2019/0156652 | A1 | 5/2019 | Berland | |
| 2019/0231148 | A1 | 8/2019 | Banks et al. | |
| 2019/0299228 | A1 | 10/2019 | Ophardt et al. | |
| 2019/0330891 | A1 | 10/2019 | Pare | |
| 2020/0163496 | A1 | 5/2020 | Tojek et al. | |
| 2020/0292366 | A1 | 9/2020 | Ophardt et al. | |
| 2020/0337506 | A1 | 10/2020 | Marshall | |
| 2022/0007897 | A1* | 1/2022 | Rossi | A47K 5/1205 |

FOREIGN PATENT DOCUMENTS

| | | | |
|---|---|---|---|
| EP | 1706011 | B1 | 12/2008 |
| EP | 1702547 | B1 | 8/2009 |
| EP | 2370327 | B1 | 4/2013 |
| EP | 2370045 | B1 | 1/2014 |
| EP | 2328690 | B1 | 1/2015 |
| EP | 2299885 | B1 | 7/2015 |
| EP | 2376346 | B3 | 1/2016 |
| EP | 2669214 | B1 | 1/2016 |
| EP | 2669215 | B1 | 1/2016 |
| EP | 2283194 | B1 | 2/2016 |
| EP | 2322068 | B1 | 4/2016 |
| EP | 2277423 | B1 | 5/2016 |
| EP | 2729701 | B1 | 8/2016 |
| EP | 2855029 | B1 | 12/2016 |
| EP | 2908956 | B1 | 5/2017 |
| EP | 2566377 | B1 | 1/2018 |
| EP | 2896340 | B1 | 5/2018 |
| EP | 3359006 | A1 | 8/2018 |
| EP | 2502677 | B1 | 12/2018 |
| EP | 2914384 | B1 | 1/2019 |
| EP | 2948255 | B1 | 1/2019 |
| EP | 2888056 | B1 | 2/2019 |
| EP | 2846925 | B1 | 3/2019 |
| EP | 2669016 | B1 | 4/2019 |
| EP | 2844118 | B1 | 4/2019 |
| EP | 2967262 | B1 | 4/2019 |
| EP | 3245924 | B1 | 4/2019 |
| EP | 3331409 | B1 | 7/2019 |
| EP | 2223642 | B1 | 9/2019 |
| EP | 3533368 | A1 | 9/2019 |
| EP | 3556472 | A1 | 10/2019 |
| EP | 2520910 | B1 | 12/2019 |
| EP | 3488937 | B1 | 7/2020 |
| EP | 3370590 | B1 | 9/2020 |
| EP | 3711645 | A1 | 9/2020 |
| EP | 3448215 | B1 | 11/2020 |
| EP | 3520662 | B1 | 11/2020 |
| EP | 3738491 | A1 | 11/2020 |
| EP | 3738492 | A1 | 11/2020 |
| WO | 02/049490 | A1 | 6/2002 |
| WO | 2017062325 | A1 | 4/2017 |
| WO | 2017077269 | A1 | 5/2017 |

* cited by examiner

DISPENSER

BACKGROUND

Field of the Disclosure

The present disclosure relates to a dispenser for dispensing a fluid, a cartridge for use with the dispenser and containing fluid to be dispensed, and a dispenser assembly comprising the dispenser and cartridge.

Description of the Background of the Disclosure

Hand hygiene product dispensing systems generally consist of a product dispenser and a refillable and/or replaceable reservoir containing the product to be dispensed.

There are two groups of people that typically use such dispensing systems. These are maintenance professionals and users. These two groups of people have different requirements in terms of what the dispensing system must provide.

For maintenance professionals, visibility of the amount of product left in the dispenser reservoir needs to be provided in order to reduce the time it takes to evaluate and service the dispenser. If product visibility is insufficient, it may be necessary to open the dispenser to judge whether the reservoir needs to be refilled or replaced, which adds unnecessary time.

On the other hand, user visibility of the product in the dispenser should be minimised to promote a hygienic appearance that encourages use of the dispenser. For example, users may be deterred by the unsightly inner workings of the dispenser or by the appearance of a low amount of product.

It is an aim of the present disclosure to address these two conflicting needs.

SUMMARY

In one aspect, a dispenser includes a front panel having a visible light transmission (VLT) value of zero and a body having a wall portion with at least two VLT values. Two of the at least two VLT values are greater than 5% and different from each other.

In some embodiments, a ratio of the at least two VLT values can be about 2:1 and the wall portion may have a viewing portion with a VLT value greater than 5%. The wall portion is part of a sidewall having a surface area, in which a surface area of the viewing portion is at least 30% of a total surface area of the sidewall. Further, at least 50% of the total surface area of the sidewall comprises a VLT value that is greater than 5% and less than the VLT value of the viewing portion. In some aspects, the wall portion includes a first VLT value in at least two portions that are discrete and spaced apart from each other, the first VLT value being greater than a second VLT value.

In some embodiments, a viewing plane is defined at an edge formed between the two VLT values and a rear plane is defined by a rear wall of the body. Further, a viewing axis can extend through the front panel and perpendicular to the viewing plane, a first viewing boundary can extend from the viewing plane at a first angle, and a second viewing boundary can extend from the viewing plane at a second angle.

In some embodiments, a first viewing zone is formed between the first and second viewing boundaries, with the front panel being disposed within the first viewing zone. Further, a second viewing zone can be formed between the first viewing boundary and the rear plane, with the two VLT values of the sidewall being disposed within the second viewing zone.

In some embodiments, a dispenser includes a front panel that is opaque and a body having a translucent wall portion that includes a transparent window. The window may be disposed at an angle relative to the front panel.

In some aspects, the body includes a rear wall that may be substantially parallel to a front surface of the front panel and the window may be disposed substantially perpendicular to and between the rear wall and the front panel. Further, a rear edge of the window can be spaced apart from the rear wall and a front edge of the window can be spaced apart from the front panel. The wall portion may be part of a sidewall and can extend from the rear wall of the body to the forward edge. Also, the sidewall can include a top portion and two opposing wall portions connected by the top portion. The forward edge of the top portion of the sidewall can extend farther from the rear wall than the forward edge of the wall portions. The window may be located on at least one of the wall portions.

In some aspects, a central plane bisects the front panel and the rear wall of the dispenser, the window extends in a first direction that is substantially parallel to the central plane, and the window extends in a second direction that is disposed at an angle relative to the central plane. Further, the front edge of the window may be located a first distance from the central plane, the rear edge of the window may be located a second distance from the central plane, and the first distance can be greater than the second distance. The window can include a first window and a second window, and an interior cavity can be formed between the first and second windows.

In some embodiments, the first window includes a first edge and the second window includes a second edge, the first edge being disposed at a different angle from the front panel than the second edge. The first window and the second window can each be located approximately centrally between a top and a bottom of the wall portion.

In still another aspect, a dispenser includes a front panel that can be opaque, and a body that includes a sidewall extending from a rear wall. Further, the front panel is coupled to the body and an interior cavity is formed therebetween. The sidewall includes an illuminating portion and a viewing portion. The illuminating portion is translucent and the viewing portion is transparent. In addition, the viewing portion is located between the front panel and the rear wall and the viewing portion and the illuminating portion may be configured to indicate a refill status.

In some aspects, a refill status of the dispenser may include at least two indicators, a first indicator that can be configured to be provided in a first direction and a second indicator that can be configured to be provided in a second direction, the first and second directions being different from each other. Further, the viewing portion may define a front edge and a rear edge extending between a top edge and a bottom edge. In some embodiments, the rear edge is disposed proximate to the rear wall and the front edge may be disposed proximate to the front panel.

In some embodiments, a cartridge is adapted to be received within the interior cavity and includes a side extending between a front side and a rear side, a base, and a neck that is disposed opposite the base. The base can be configured to cooperate with the top edge of the viewing portion to provide the first indicator of the refill status. In some examples, a cartridge is configured to collapse during use and the front side and the rear side are configured to move toward each other as the cartridge collapses. The base can be configured to move toward the neck when the cartridge collapses and the cartridge is configured to collapse from a first state to a second state to a third state. Each of the front side, the rear side, and the base may be configured to be hidden from view through the viewing portion in the first state. Further, at least one but no more than two of the front side, the rear side, and the base may be configured to be visible through the viewing portion in the second state. In addition, each of the front side, the rear side, and the base may be configured to be visible through the viewing portion in the third state.

In some aspects, at least one of the viewing portion and the illuminating portion can include a symbol that can be configured to communicate at least one aspect of the refill status. The refill status may be configured to be communicated by a contrast in color. The viewing portion can include a plurality of transparent regions that are each bordered on all sides by the illuminating portion. Further, the illuminating portion can include an opening and the viewing portion may not include an opening.

In yet another aspect, a cartridge for use within a dispenser includes an outlet end, a base end opposite the outlet end, a front wall, a rear wall, and two side walls. The outlet end has a shoulder and an annular collar that extends about an axially extending neck that defines an opening into an inner volume of the cartridge. The front, rear, and two side walls extend from the outlet end to the base end. A vertical plane is disposed centrally between the two side walls and intersects the front wall and the rear wall. Further, the two side walls include a first side wall and a second side wall that each carry a respective first and second valley. Each of the first valley and the second valley is bordered by a top peripheral edge, a front peripheral edge, a rear peripheral edge, and a bottom peripheral edge. A front panel extends from the front peripheral edge toward a vertical fold line, a rear panel extends from the rear peripheral edge to the vertical fold line, an upper panel extends from the top peripheral edge to the vertical fold line, and a lower panel extends from the bottom peripheral edge to the vertical fold line. The vertical fold line is located closer to the vertical plane than the top, front, rear, and bottom peripheral edges. The vertical fold line extends between an upper junction connected to an upper pair of angled fold lines and a lower junction connected to a lower pair of angled fold lines. The upper panel extends between the upper pair of angled fold lines, the lower panel extends between the lower pair of angled fold lines, and the upper panel defines a surface area that is less than a surface area of the lower panel. The upper junction is located closer to the top peripheral edge than the lower junction is located to the bottom peripheral edge.

In some embodiments, each of the upper panel and the lower panel can be substantially triangular-shaped and has a substantially planar surface. Further, on collapsing of the container under a vacuum applied to withdraw fluid from the opening, the front wall and rear wall are drawn toward each other, and the first and second side walls may fold along respective upper and lower pairs of fold lines and vertical fold lines.

In another aspect, a cartridge includes a front wall, a rear wall, a pair of side walls, and a base that is opposite a neck. The cartridge further includes a shoulder section extending at an angle from the neck to each of the front wall, the rear wall, and the pair of side walls, an open mouth extending through the neck to an inner volume, a vertical axis extending centrally through the cartridge, and a plurality of creases. A first crease and a second crease each extend along the front wall perpendicular to the vertical axis and between the pair of sides. The first crease may be located a first distance from the shoulder and the second crease can be located a second distance from the base. The second distance can be greater than the first distance.

In some embodiments, the cartridge can be at least partially opaque. In other embodiments, the cartridge can be at least partially translucent, having a VLT value greater than 5%. In some examples, a label may be affixed to at least one of the front wall and the rear wall. In some embodiments, a rib can extend along the shoulder between the neck and one of the pair of side walls. In some examples, the first and second creases can define a collapse pattern and the cartridge may be configured to collapse according to the collapse pattern.

In still another aspect, a cartridge includes an inner volume, a neck extending from a shoulder portion, a front wall opposite a rear wall and a right wall opposite a left wall, and a base. The neck defines an opening that is in communication with the inner volume cavity. The cartridge is configured to be inserted into a dispenser having a front panel that is opaque and a body that includes at least two visible light transmission (VLT) values, each of the VLT values being greater than 5%.

In some embodiments, the cartridge has a VLT value greater than 5%. In some aspects, the cartridge is inserted into the dispenser a first portion of the cartridge is configured to be visible through a viewing portion having a VLT value greater than 5% and a second portion of the cartridge is configured to be hidden from view through the viewing portion. In some aspects, a label is affixed to at least one of the front wall and the rear wall, and the label can be configured to be hidden from view when the cartridge is inserted into the dispenser. The cartridge can be configured to be received by the dispenser in an inverted orientation. In some examples, the cartridge is configured to contain a fluid within the inner volume cavity and the fluid is configured to be visible when the cartridge is inserted into the dispenser.

In another aspect, a dispenser for dispensing a fluid is provided, the dispenser comprising a dispenser body that at least partially defines an interior of the dispenser and is configured to house a cartridge containing a fluid to be dispensed. In some embodiments, the dispenser body includes a front panel that is configured to be presented to a user when in use. In some embodiments, the front panel includes an opaque material such that at least a portion of the interior of the dispenser is not visible through the front panel. In some embodiments, the body of the dispenser includes an illuminating portion that is configured to permit entry of ambient visible light into the interior of the dispenser through the illuminating portion. Further, the body includes a viewing portion that is configured to face in a different direction than the front panel when in use and the viewing portion is configured to permit the cartridge to be viewed through the viewing portion. In this way, the dispenser simultaneously satisfies the viewing requirement of the maintenance professional and the viewing requirement of the user or owner.

When using a dispenser, the user typically stands close to and in front of the front panel of the dispenser in order to operate the dispenser to dispense fluid. The front panel conceals at least a portion of the interior dispenser to provide an improved aesthetic, which is particularly desirable in high-end, high traffic commercial environments, such as, e.g., in a public washroom.

In addition, maintenance professionals desire the ability to quickly assess an amount of fluid in the dispenser to determine when the dispenser will require maintenance, e.g., replacement of a cartridge. Such an assessment often occurs at a distance from the dispenser and, preferably, without opening or obstructing access to the dispenser.

Accordingly, the illuminating portion and the viewing portion provide an effective way of assessing an amount of fluid remaining in the dispenser while also providing an improved aesthetic for users. Maintenance professionals are able to assess the amount of fluid remaining in the dispenser by the viewing portions, which face a different direction than the front panel. The interior of the dispenser is illuminated by ambient visible light entering the interior of the dispenser by the illuminating portion and the viewing portion. In some embodiments, a fluid fill line is visible through the viewing portion and the cartridge to facilitate the maintenance professional in assessing the amount of fluid in the dispenser. This is particularly important where the fluid itself is difficult to see, e.g., transparent or semi-transparent or translucent. In this way, a maintenance professional can efficiently determine an amount of fluid in the dispenser from a distance without opening or obstructing access to the dispenser. Further, improved visibility of an amount of fluid in the dispenser can improve refill or maintenance efficiency by saving maintenance professionals time and by enabling more accurate determination of the fluid level or status of the dispenser.

In some embodiments, the illuminating portion is configured to face vertically upward in use, e.g., located on a top portion. In this way, the interior of the dispenser is illuminated by ambient visible light that is provided by overhead lighting, skylights, or the like. Further, the front panel can define a first viewing zone and the viewing portion can define a second viewing zone. In the first viewing zone, e.g., an actuation viewing zone, the cartridge housing in the interior of the dispenser is concealed or hidden by the front panel. In the second viewing zone, the cartridge housed in the interior of the dispenser is visible through the viewing portion. In some embodiments, the second viewing zone includes a pair of viewing zones located on opposing sides of the first viewing zone. In this way, a maintenance professional can assess the amount of fluid within the dispenser without being directly in front of the dispenser, e.g., in the first viewing zone or actuation viewing zone.

It is contemplated that the front panel is constructed entirely of an opaque material. It is further contemplated that the illuminating portion and/or the viewing portion is constructed of a transparent, semi-transparent, and/or translucent material. In this way, effective illumination of the interior of the dispenser is achieved while concealing or hiding the interior of the dispenser from particular perspectives or views, e.g., within the first viewing zone or actuation viewing zone. It is also contemplated that the illuminating portion is provided as translucent, such as, e.g., by treating an internal surface of a material forming at least a portion of the illuminating portion. In some embodiments, such treatment may include etching according to a variety of methods. In some embodiments, such treatment may include frosting or an application of substances, substrates, adhesives or the like.

In some embodiments, the viewing portion is provided as transparent or semi-transparent. In some embodiments, the viewing portion is located centrally between a front and a rear of the dispenser. In some embodiments, the viewing portion is located closer to the rear of the dispenser than to the front of the dispenser. In some embodiments, the dispenser has a body depth from a front-most edge to a rearmost edge, when in a closed configuration, and the viewing portion has a viewing depth from a front edge to a rear edge. Further, a centerpoint of the viewing depth of the viewing portion is located rearwardly of a centerpoint of the body depth of the dispenser.

In some embodiments, the viewing portion includes a plurality of regions through which the interior of the dispenser is visible, e.g., a plurality of transparent regions. Further, the plurality of regions can be spaced apart from each other and located in alignment with the cartridge. In this way, the viewing portion can be configured to expose multiple portions of the cartridge to effectively convey all fluid levels from full to empty through a single viewing portion. In some embodiments, the viewing portion includes a plurality of discrete regions, e.g., small regions, which are configured to enhance the aesthetic. In some embodiments, the discrete regions are configured to be aligned with particular portions of the cartridge that relate to particular fluid levels from full to empty, such that a single discrete region exposes a binary indication of a fluid level. In some embodiments, the viewing portion includes a plurality of viewing portions that are located on opposing sides of the dispenser. In this way, visibility of the interior of the dispenser is enabled through any one of the plurality of regions or discrete regions.

In some embodiments, a front panel of the dispenser includes a curved profile in a side-to-side direction, such that the front panel bows outward with respect to a rear wall of the dispenser. In some aspects, the body of the dispenser includes a rear wall from which a top portion and opposing sides extend. In some embodiments, the top portion of the body extends farther from the rear wall than opposing sides. In addition, the front panel fits across the top portion and the opposing sides of the body, such that the top portion and the opposing sides are configured to mate with the curved profile of the front panel. In this way, when an illuminating portion is formed on the top portion of the dispenser, greater amounts of ambient visible light can enter the interior of the dispenser. Accordingly, a cartridge within the interior of the dispenser is not visible through the front panel and the curved profile of the front panel acts to enhance the aesthetic of the dispenser. The curved profile of the front panel also corresponds to the opposing sides on which viewing portions are positioned nearer the rear of the dispenser, with respect to an overall dispenser depth, such that viewing portions are more discrete.

In some embodiments, the dispenser body comprises a sidewall that extends from a rear wall and the sidewall extends about a first side of the dispenser, a top portion of the dispenser, and a second side of the dispenser to form a continuous sidewall. In some embodiments, the dispenser may comprise a curved upper surface extending between the first and second sides of the dispenser. In other embodiments, the sidewall may comprise a first sidewall, an upper wall, and a second sidewall which may comprise a single component integrally formed, or which are made of separate components. In some embodiments, the first side, second side and upper walls are substantially straight and are coupled together at an angle, e.g., 90 degrees.

In some aspects, the sidewall extends inwardly as it extends toward the rear wall. Said another way, the front of the dispenser has a larger area in a front-on view as compared to the rear of the dispenser. Put another way, the sidewall tapers inwardly as it extends from the front panel toward the rear wall. In this way, more discrete positioning of the viewing portion and/or illuminating portion can be achieved, thereby enhancing the aesthetic of the dispenser and the user's viewing experience.

In some embodiments, the viewing portion and/or the illuminating portion are provided by the sidewall of the dispenser body. In some embodiments, the viewing portion and/or the illuminating portion are integral with the sidewall of the dispenser body. In this way, the number of components required to make the dispenser is reduced, resulting in lower dispenser manufacturing costs and material consumption.

In some embodiments, the illuminating portion is formed of a translucent material and the viewing portion is formed of a transparent material. In some embodiments, the illuminating portion is provided by a region of the sidewall, which is formed of a translucent material.

In some embodiments, the dispenser includes a support structure, e.g., a collar, for supporting a cartridge housed in the dispenser, and the sidewall includes a translucent material in the region of the support structure to at least partially impede viewing of the support structure therethrough. In addition, the front panel includes blinders that extend across an area corresponding to a region in which the support structure is located to at least partially impede viewing of the support structure. The support structure may be considered to be unsightly, therefore the provision of a translucent material in the region of the support structure and/or the blinders of the front panel improves the aesthetic of the dispenser and the viewing experience by a user.

In some embodiments, the dispenser body has a first body portion, e.g., including the front panel and a portion of the sidewall, and a second body portion, e.g., including the rear wall and a portion of the sidewall. In some embodiments, the first body portion and the second body portion are moveable relative to each other between a closed configuration, in which the interior of the dispenser is covered, and an open configuration, in which the interior is exposed. In some embodiments, the first and second body portions are configured to pivot relative to each other about a hinge axis located at a lower end of the dispenser.

In some embodiments, the hinge axis is substantially horizontal when the dispenser is in use. In this way, an opening mechanism is provided such that it is easy for a maintenance professional to replenish fluid in the dispenser. It will be appreciated that any suitable mechanism for accessing an interior of the dispenser can be used. In some aspects, the dispenser is configured to be secured to a substantially vertical surface via the rear wall. In some aspects, the rear wall and the sidewall are integrally formed. In this way, providing the rear wall and sidewall as a single integrally formed component reduces the component count of the dispenser and hence reduces cost and material consumption. In some embodiments, the sidewall is configured to extend from the rear wall such that it meets the front panel when the dispenser is in the closed configuration.

In a further aspect, a dispenser assembly is provided comprising a dispenser as disclosed herein and a cartridge housed in the interior of the dispenser and containing a fluid to be dispensed. The cartridge is configured to collapse in a predetermined manner as the fluid is dispensed. Accordingly, use of a dispenser disclosed herein, together with a collapsible cartridge, serves to effectively hide the cartridge from view to those who are using the dispenser i.e., those in the first viewing zone, thereby providing an improved aesthetic while also enabling a maintenance professional to assess an amount of fluid in the cartridge.

A maintenance professional will in some instances make an assessment of an amount of fluid in a cartridge based upon a combination of a level of fluid remaining in a cartridge and/or a degree of collapse. Accordingly, visibility of the cartridge via the viewing portion and illumination by the illuminating portion ensure that a maintenance professional can easily make this assessment. Collapsible cartridges, i.e., sealed cartridges, are also advantageous in overcoming hygiene issues associated with non-sealed systems. By using a sealed cartridge that cannot be refilled with product and does not let air into the cartridge as the fluid is dispensed, the quality of the fluid can be preserved.

In some embodiments, the viewing portion of the dispenser is configured, e.g., sized and shaped and located, such that a fluid fill level of the cartridge can be viewed through the viewing portion when the fluid fill level is between an upper level and a lower level. In some aspects, the upper level corresponds to the cartridge being 20% full or greater, such as, e.g., 40% full, 50% full, 60% full, 80% full or 100% full. In some embodiments, the lower level corresponds to the reservoir being less than 20% full or substantially empty. In this way, the viewing portion need only be big enough to see a portion of the collapsing cartridge for determining an amount of fluid remaining in the cartridge. This ensures that the viewing portion can be minimized, i.e., smaller in size, to enhance the aesthetic of the dispenser, while not impeding the ability of a maintenance professional to assess an amount of fluid in the cartridge.

In some embodiments, the viewing portion is narrower than the widest part of the cartridge when the cartridge is viewed in side profile. In some aspects, the viewing portion is narrower than the widest part of the cartridge when the cartridge is viewed in side profile as the cartridge collapses from 100% full to empty. In this way, the size of the viewing portion can be reduced so as to improve the aesthetic appearance of the dispenser without compromising on a maintenance professional's ability to assess an amount of fluid in the cartridge.

In some embodiments, the cartridge comprises fold lines arranged such that the predetermined manner of collapse comprises the cartridge collapsing such that, when the cartridge is viewed in side profile, a narrow waist is formed between comparatively wider upper and lower portions of the cartridge as the cartridge depletes, the waist including portions of a front-most wall and a back-most wall. Said another way, the side profile of the cartridge resembles a similar shape to the cross section of an I-beam. In this way, the majority of the deformation taking place in the cartridge occurs in the side profile and follows a distinctive collapsing manner. This facilitates a maintenance professional when determining an amount of fluid left in the cartridge by taking into account a visible fluid fill level in combination with the collapsed shape of the cartridge. Based on this and the maintenance professional's experience of dispenser usage rates, the maintenance professional can assess whether the cartridge needs to be replenished and/or refilled and/or replaced.

In some embodiments, the viewing portion of the dispenser is configured, e.g., sized and/or located, such that the front-most wall and/or the back-most wall of the waist can be viewed through the viewing portion when the cartridge is 80% full or less, e.g., 60% full or less, e.g., 40% full or less, e.g., 20% full or less. In this way, the viewing portion is configured to view the waist of the cartridge as it collapses. This is significant as once the cartridge has collapsed in this manner, the fluid fill level visible in the cartridge becomes more significant in determining an amount of fluid left in the cartridge. At such a level of collapse, the amount of fluid left in the cartridge will be comparatively low and so accurate assessment of the fluid level visible is important in the maintenance professional's assessment. This also ensures the viewing portion is minimized, i.e., as small as possible, to improve compliance with the user desire to hide the cartridge. In some embodiments, a height of the viewing portion is less than a height of the cartridge when the cartridge is approximately 100% full. In this way, a more discrete viewing portion is provided.

In some embodiments, the front panel extends to cover an area corresponding to a region of the interior in which the cartridge is housed, such that viewing of the cartridge through the front panel is impeded or prevented. In this way, the dispenser is provided with an enhanced aesthetic in which the cartridge is hidden from view.

In some embodiments, the dispenser includes guide formations and the cartridge includes corresponding location formations that correspond to the guide formations to facilitate installation of the cartridge in the dispenser. In this way, proper location of the cartridge in the dispenser is ensured, which is important to ensure that the viewing portions are correctly aligned with the cartridge as it collapses.

In some embodiments, the cartridge includes an opening defined by a neck coupled to a cartridge body by a shoulder, and the shoulder is provided with ribs to reinforce the shoulder against deformation during collapse of the cartridge. Collapse of the cartridge can be controlled such that the position of the waist is provided toward a base of the cartridge, i.e., opposite the cartridge neck/opening. This facilitates dispensing of fluid from the cartridge such that fluid is less likely to become trapped in the cartridge.

In some embodiments, the cartridge is placed in a dispenser with the opening disposed lowermost, i.e., inverted. Accordingly, the provision of ribs has been found to have the effect of moving the collapsed waist position away from the cartridge neck, i.e., upward toward the base of the cartridge. This reduces the chance of fluid becoming trapped in the region of the cartridge above the waist, i.e., between the waist and the base of the cartridge.

In a further aspect, the ribs are effective in maintaining the shape of the shoulder as the cartridge deforms. For example, the ribs at least partially prevent the shoulder from becoming deformed to form wells in which fluid can become trapped when the cartridge is in use. In some aspects, the ribs extend radially outward from the neck and in opposite directions relative to one another, e.g., disposed 180 degrees from one another relative to a central axis of the neck. In some embodiments, the ribs extend from the neck toward the cartridge body. In some aspects, the ribs includes a pair of support ribs extending in substantially opposite directions relative to one other and with respect to the neck. In some aspects, the ribs extend sideways from the neck.

In some embodiments, the one or more support ribs may extend in a side-to-side direction. It will be appreciated that a side of the cartridge corresponds to the side in which a narrow waist is formed when viewed from the side during collapse. In some embodiments, the cartridge body includes front and rear walls, a first side wall and a second side wall, wherein the first and second side walls extend between the front and rear walls. In some embodiments, the front wall, rear wall, first side wall, and second side wall extend between a base and the shoulder of the cartridge, such that the first side wall and second side wall are viewed when the cartridge is viewed in a respective side profile. In some embodiments, the front wall and/or rear wall comprise a curved profile in a side-to-side direction, such that they are bowed outwards with respect to an interior of the cartridge. This enables an increased cartridge volume to be provided, while still achieving the desired predetermined collapse profile.

In some embodiments, the front wall and/or rear wall comprise one or more of the fold lines extending in a sideways direction. This facilitates folding of the cartridge into approximately an "I-beam" shape as it collapses. In other words, the side profile of the cartridge as it collapses adopts a similar shape to the cross section of an I-beam. In some embodiments, the front wall and/or rear wall comprise a pair of lateral fold lines distributed along a height of the cartridge body, wherein the first and/or second fold line is offset from an even spacing of fold lines along the height of the cartridge body in a direction toward the neck. To that end, where there is a pair of fold lines provided in the front wall and/or rear wall, if these were to be distributed evenly along the height of the cartridge body, they would be positioned at a height one third and two thirds respectively along a height of the cartridge body. Where the fold lines are offset from this even spacing, they are offset from the one third and two thirds positions respectively in the direction toward the neck of the cartridge. It has been found that locating the fold lines in this way ensures a more desirable collapse profile in which the waist portion is moved away from the cartridge neck.

In some embodiments, the first side wall and/or the second side wall comprise one or more of said fold lines extending in a longitudinal direction, i.e., in a direction extending between the base and the neck of the cartridge. This can be thought of as a longitudinal fold line. This facilitates folding of the cartridge into approximately an "I-beam" shape as it collapses. In other words, the side profile of the cartridge as it collapses adopts a similar shape to the cross section of an I-beam. In some embodiments, the longitudinal fold line of the first and/or second side walls comprises a first end that is proximal the neck of the cartridge, and a second end that is proximal the base of the cartridge. The distance between the first end and an upper end of the cartridge body, which is proximal the neck, is less than the distance between the second end and a lower end of the cartridge body, which is proximal the base. Said another way, where there is a longitudinal fold line having a first end and a second end provided in the first side wall and/or the second side wall, if the first and second ends were to be distributed evenly along the height of the cartridge body, they would be positioned at a height one third and two thirds respectively along a height of the cartridge body. Where the first and second ends of the respective longitudinal fold lines are offset from this even spacing, they are offset from the one third and two thirds positions respectively in the direction toward the neck of the cartridge. It has been found that locating the longitudinal fold lines in this way ensures a more desirable collapse profile in which the waist portion is moved away from the cartridge neck.

In some embodiments, an upper front fold line and/or an upper rear fold line extends from the first end of the longitudinal fold line. The upper front fold line extends from the first end toward the front wall, e.g., toward a corner formed between the front wall and the shoulder. The upper rear fold line extends from the first end toward the rear wall, e.g., toward a corner formed between the rear wall and the shoulder. In some embodiments, a lower front fold line and a lower rear fold line extend from the second end of the longitudinal fold line. The lower front fold line extends from the second end toward the front wall, e.g., toward a corner formed between the front wall and the base. The lower rear fold line extends from the second end toward the rear wall, e.g., toward a corner formed between the rear wall and the base. In some embodiments, the first end of the longitudinal fold line is positioned in longitudinal alignment with a lateral fold line on the front and/or rear wall. In some embodiments, the second end of the longitudinal fold line is positioned in longitudinal alignment with a lateral fold line on the front and/or rear wall.

In some embodiments, the cartridge body defines a valley in which a respective fold line is located. In this way, the cartridge is encouraged to collapse in the predetermined manner. Accordingly, enhanced control of the collapse of the cartridge is provided since the valleys ensure a slight fold of the fold lines in a direction of collapse. In some embodiments, a depth of the cartridge between the front wall and the rear wall narrows in the location of the fold lines. In some embodiments, the cartridge is blow molded. This provides an easy method of manufacture.

In some embodiments, the support ribs are hollow such that they are open to the interior of the cartridge. Such ribs can be sized so that they do not trap fluid in the cartridge. In a further aspect, a dispenser assembly is provided comprising a dispenser as disclosed herein, and a cartridge as disclosed herein.

It will be appreciated that the features described herein may apply to any aspect disclosed herein. All combinations contemplated are not recited explicitly for the sake of brevity.

BRIEF DESCRIPTION OF THE DRAWINGS

Embodiments will now be described, by way of example only and with reference to the accompanying drawings, in which.

DETAILED DESCRIPTION

Figure 1:
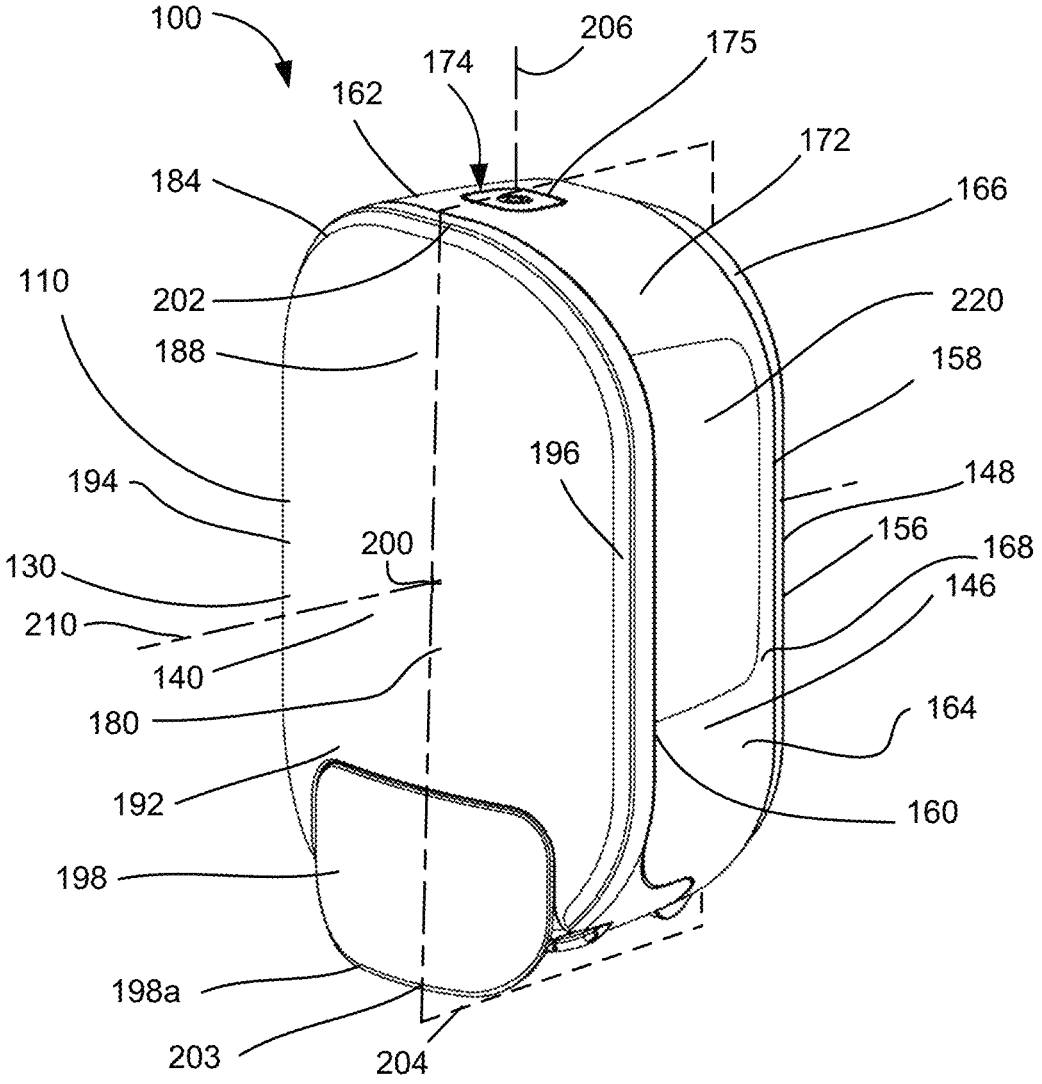
FIG. 1 is a perspective view of an embodiment of a dispenser assembly in a closed configuration, where a housing of the dispenser assembly is illustrated without shade lines for purposes of clarity.

The present disclosure is directed to a dispenser assembly for dispensing fluid. The dispenser assembly includes a dispenser and a fluid cartridge. While the embodiments of the present disclosure may take many different forms, several embodiments are discussed herein with the understanding that the present disclosure is to be considered as exemplary, and it is not intended to limit the invention to the embodiments illustrated.

Further, the fluid discussed herein may comprise a soap, shampoo, hand sanitiser, lotion, cleaning agent or other desired fluid. As used herein, the term "soap" is intended to include any liquid detergent or cleaning product suitable for being dispensed from a fluid dispenser. Additives may be included in the fluid and/or soap, such as, for example, fragrances, preservatives, moisturizers, dyes, and particulates, among others.

As used herein, the term "transparent material" is intended to mean any material that allows light to pass through so that objects behind can be clearly seen. As used herein, the term "translucent material" is intended to mean any material that allows some light to pass through, but objects behind cannot be clearly seen.

In addition, "visible light transmission" is used herein as a measurement of the quantity or amount of visible light that is allowed to pass through a material, which may be represented as a percentage. For example, a layer or surface that transmits half of the visible light is considered to have a 50% VLT value. The "transparent material" is associated with a high VLT value, which is in a range of 86-100% VLT. The "translucent material" is associated with a low or medium VLT value, which is in a range of 6-85% VLT. The "opaque material" is associated with no or a very low VLT value, which is 5% or less VLT.

For purposes of clarity, it will be understood by those of skill in the art that numerous standards exist for measuring the transparency/translucency/opaqueness of a material. In the present implementations, ASTM standard D1003 2021 Edition (Standard Test Method for Haze and Luminous Transmittance of Transparent Plastics) was used to measure the visible light transmissivity and, thus, the relative transparency/translucency/opaqueness of the herein-described materials. Further, it is intended that the suggested testing protocols be followed for the particular material being reviewed and that if Procedure A, which utilizes a hazemeter, or Procedure B, which used a spectrophotometer, provide for different visible light transmission results/percentages, that the higher value of the two procedures be used for purposes of the present disclosure. It is also contemplated that if a subject material to be considered for purposes of this disclosure has a non-planar configuration, e.g., a curved window in a subject device, that a planar portion of the particular material be used for testing purposes.

Alternatively, ASTM standard D1746 2021 Edition (Standard Test Method for Transparency of Plastic Sheeting) may be used to measure opacity and, thus, the relative transparency/translucency/opaqueness of the herein-described materials, with suitable standardized equipment, such as an opacity meter. As used herein, the term "opacity" refers to the extent to which a surface, an object, or a layer of material impedes the transmission of light through it and, thus, is the inverse of the VLT measurement referenced herein. It is contemplated that opacity and VLT may be used interchangeably and that measurements according to either ASTM D1003 or ASTM D1746 may be used; however, for purposes of this disclosure, the measurements of VLT according to ASTM D1003 protocols are preferred. Further, where alternative materials are used, other standards should be followed, such as ASTM C1549-14 2021 edition (Standard Practice for Instrumental Transmittance Measurement of Color for Flat Glass, Coated and Uncoated), among others.

Referring to the drawings, FIGS. 1-4 depict a dispenser assembly 100 having a dispenser 110 adapted to accommodate a refill or cartridge 120. The dispenser 110 includes a front panel or cover 130 that is movably coupled to a body 140 to enclose an interior cavity 142. In one instance, the front panel 130 is rotatable or pivotable about a hinge 144, although other configurations are possible. The body 140 includes a wall portion or sidewall 146 that extends from a rear wall or backplate 148 to at least partially define the interior cavity 142. The rear wall 148 is configured to be mounted to an external surface (not shown), such as, e.g., a wall, a free-standing support, or any other suitable surface. The cartridge 120 is configured to be received within the interior cavity 142 and, in particular, the cartridge 120 is mounted in an inverted orientation within a collar 150 carried by the body 140. The cartridge 120 includes a pump assembly 152 and a nozzle 154 that is configured to apply a suction force or vacuum to dispense fluid when the pump assembly 152 is actuated by a user.

In the illustrated embodiment, the rear wall 148 is a substantially planar portion and the sidewall 146 extends from a periphery 156 of the rear wall 148 to at least partially define the interior cavity 142. The sidewall 146 extends from a rear end 158 to a front end 160 and from a top end 162 to a bottom end 164. In the illustrated embodiment, a recessed section 166 extends along the rear end 158 of the sidewall 146 and the rear wall 148 and, preferably, from the top end 162 to the bottom end 164. Further, the recessed section 166 curves inwardly from the top end 162 of the sidewall 146 to the rear wall 148, although other configurations are possible. In addition, the recessed section 166 may vary in size along the body 140, such as, e.g., being larger near the top end 162 of the sidewall 146 and smaller toward the bottom end 164, although other configurations are possible. Further, the sidewall 146 includes opposing sides 168, 170 (i.e., first and second sides) that extend from the top end 162 to the bottom end 164 and from the rear end 158 to the front end 160. In the illustrated embodiment of FIGS. 1-4, the top end 162 is connected to each of the opposing sides 168, 170 at a transition portion 172. Further, as illustrated in FIGS. 1, 2, and 4, the top end 162 includes an opening 174 formed therethrough in which an opaque release device 175 is provided.

In the illustrated embodiment, the body 140 and the front panel 130 are constructed of a plastic material. A preferred plastic material is an ABS resin (acrylonitrile-butadiene-styrene). However, other plastic materials, such as, e.g., a PC resin (polycarbonate polymer), a PETG resin (polyethylene terephthalate glycol), a PP resin (polypropylene polymer), poly(methyl methacrylate) (PMMA or acrylic), styrene methyl methacrylate (SMMA), polystyrene (PS), methacrylate styrene copolymer (MS), cured urethane, polyester, silicone, a PVC resin (polyvinyl chloride), and the like may be used without departing from the scope of this disclosure. Preferably, the body 140 is constructed of a transparent resin of the same plastic material used to construct the front panel 130. However, in some embodiments, the front panel 130 is made of a different plastic material than the body 140. It is further contemplated that the body 140 may be made of portions of different materials. In some examples, portions of the body 140 are made of glass, such as, e.g., water-clear (low-iron) glass. Alternatively, the sidewall 146 or portions thereof may be made of an ABS resin while other portions of the sidewall and/or the body 140 may be made of another of the plastics mentioned above. In addition, it is contemplated that the VLT value of any of the materials and/or portions of the dispenser may be a function of the materials used, as well as any surface treatments or coating applied thereto. In some examples, the surface treatment, e.g., molding, stamping, printing, compressing, cutting, etching, sanding, vacuum forming, etc., and/or coating, e.g., paint, adhesives, and the like, may be imparted on a single side or on opposing sides of the plastic material to control the VLT value thereof.

As illustrated in FIG. 1, the front panel 130 is coupled to the front end 160 of the sidewall 146 of the body 140 and spans across the top end 162 and the bottom end 164 and between the opposing sides 168, 170. The front panel 130 includes a front wall 180 that is connected to a perimeter 184 and extends from an upper section 188 to a lower section 192 and between side sections 194, 196. A trigger or actuator 198 is coupled to the front panel 130 at the lower section 192 to be substantially flush with the front wall 180, and the trigger 198 has a curved perimeter **198*a* extending thereabout. A midpoint 200 of the front panel 130 is centrally disposed on the front wall 180 between the perimeter 184 and between the upper and lower sections 188, 192 of the front wall 180. Further, the perimeter 184 includes a peak 202 that is located at an uppermost point of the front panel 130, and the peak 202 is intersected by a central plane 204 that also intersects the midpoint 200. Further, a lowermost point 203 of the dispenser 110 is located along the curved bottom edge 198*a* of the trigger 198. The central plane 204 is further defined by a central axis 206, which is centrally positioned through the dispenser 110 between the opposing sides 168, 170 and between the rear wall 148 and the front wall 180, such that the central plane 204 also intersects the central axis 206. As such, the peak 202 of the perimeter 184, the lowermost point 203, and the midpoint 200 of the front wall 180 are coplanar relative to the central plane 204**.

Figure 2:
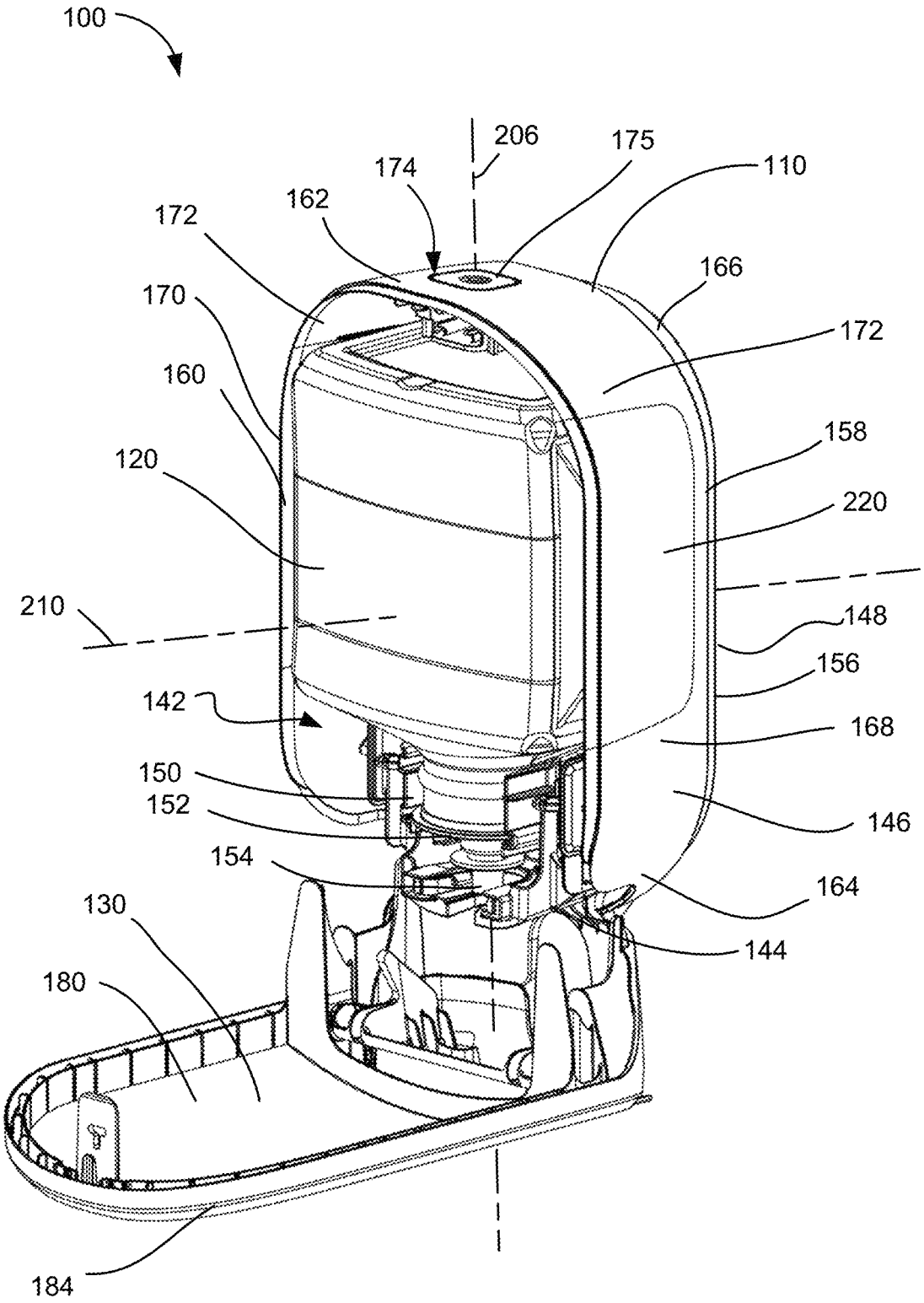
FIG. 2 is a perspective view of the dispenser assembly of FIG. 1 in an open configuration and receiving a cartridge therein.
Figure 3:
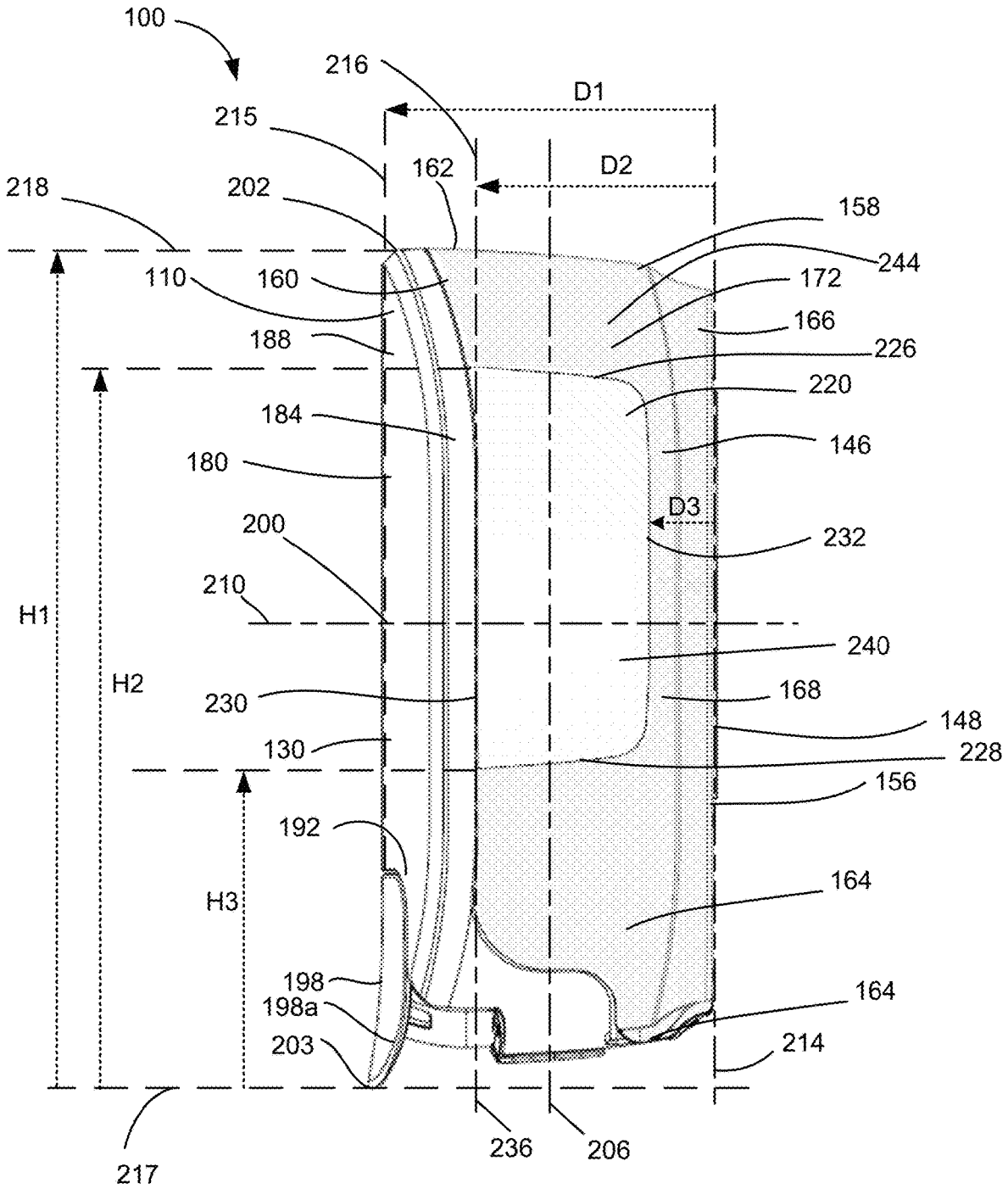
FIG. 3 is a side elevational view of the dispenser assembly of FIG. 1 in a closed configuration, where a body of the dispenser assembly is depicted as including transparent and translucent portions.
Figure 4:
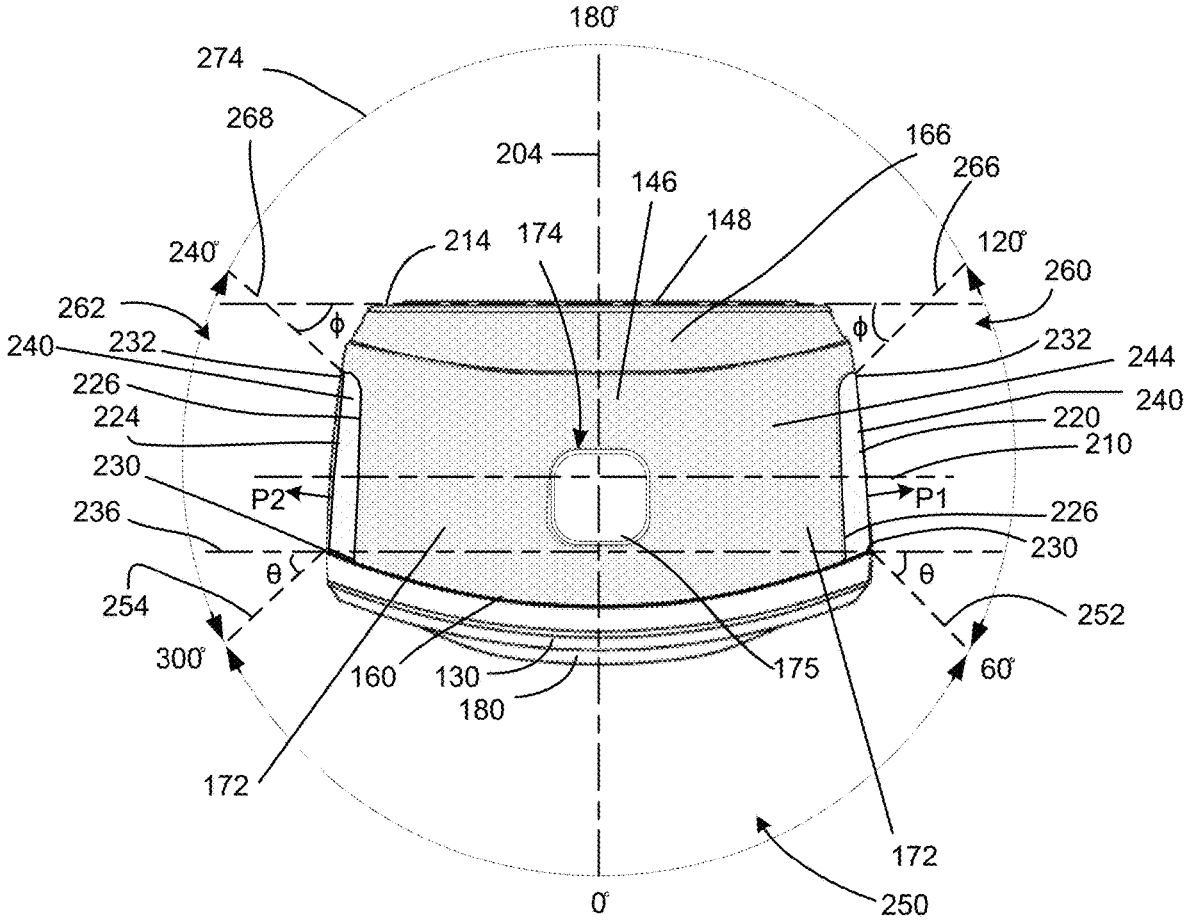
FIG. 4 is a top plan view of the dispenser assembly of FIG. 1 in a closed configuration, where a body of the dispenser assembly is depicted as including transparent and translucent portions.

Referring to FIGS. 2-4, the central axis 206 is illustrated as extending generally vertically in a top-to-bottom direction. Further, a lateral axis 210 is illustrated as being centrally positioned between the top end 162 and the bottom end 164 of the body 140. The lateral axis 210 extends generally horizontally in a front-to-rear direction that is substantially perpendicular to the central axis 206. The central plane 204 extends through the central axis 206 and bisects the dispenser 110, including the front panel 130 and the rear wall 148. As illustrated in FIG. 3, a depth D1 of the dispenser 110 is measured in a direction parallel with the lateral axis 210. In particular, the depth D1 is measured between a front plane 215 that is parallel with the central axis 206 and tangent or otherwise coincident to a front-most portion of the front wall 180 and a rear plane or back plane 214 that is parallel to the central axis and tangent or otherwise coincident to a rear-most portion of the rear wall 148 of the body 140. Further, a depth D2 of the body 140 is measured between a front end plane 216 parallel with the central axis 206 and tangent or otherwise coincident to a portion of the front end 160 aligned with the lateral axis 210, and the back plane 214 of the body 140. When the front panel 130 is coupled to the body 140, the depth D2 is measured between the front end plane 216 and the back plane 214. In addition, a height H1 of the dispenser 110 is measured in a vertical direction parallel with the central axis 206. In particular, the height H1 is measured with reference to a bottom end plane 217 that is parallel with the lateral axis 210 and tangent or otherwise coincident to a lower-most portion of the dispenser 110 and an upper end plane 218 that is parallel to the lateral axis 210 and tangent or otherwise coincident to an upper-most portion of the dispenser 110. When the front panel 130 is coupled to the body 140, the upper end plane 218 is aligned with the peak 202 and the bottom end plane 217 is aligned with the lowermost point 203. It is understood that although the lowermost point 203 is located on the trigger 198, the dispenser 110 can accommodate a variety of triggers of any size and/or shape, such that the lower most point 203 may be located on the body 140 rather than the trigger 198.

In some embodiments, the sidewall 146 and the rear wall 148 are integrally formed with each other. Further, the sidewall 146 extends in a continuous U-shape from the bottom end 164 to the top end 162 and substantially linearly between the front end 160 and the rear end 158. In addition, the opposing sides 168, 170 extend substantially linearly between the top end 162 and the bottom end 164, and the transition portions 172 curve downwardly from the top end 162 to the each of the opposing sides 168, 170. It will be appreciated that the opposing sides 168, 170 may be referred to as first and second sides 168, 170 or left and right sides, respectively. The front end 160 of the sidewall 146 is generally curved between the top end 162 and the bottom end 164 of the sidewall 146, such that the top end 162 extends farther from the rear wall 148 than the opposing sides 168, 170. Accordingly, the front end 160 is farthest from the rear wall 148 and/or the rear end 158 at the top end 162. As such, the depth D2 of the body 140 is greater at the top end 162 than along the opposing sides 168, 170. More particularly, the uppermost and frontmost portion of the body 140 is aligned with the upper end plane 218 and the front plane 215, so as to have a depth that is greater than D2 from the back plane 214 and a height that is approximately equal to the height H1 from the bottom end plane 218, while the opposing sides 168, 170 are aligned with the front end plane 216 so as to have a depth approximately equal to D2 from the back plane 214.

Referring to FIGS. 3 and 4, the sidewall 146 includes windows 220, 224 therealong and, in particular, each of the opposing sides 168, 170 includes the window 220, 224, respectively, located between the top end 162 and the bottom end 164 of the sidewall 146 and approximately centrally on the opposing sides 168, 170, respectively, between the transition portions 172 and the bottom end 164. In some embodiments, the windows 220, 224 are located between and spaced apart from the top end 162 and the bottom end 164 of the body 140. Preferably, the windows 220, 224 are formed integrally with the sidewall 146 of the body 140, so as to be made of the same plastic materials as the body 140, such as those described above. In some embodiments, the windows 220, 224 are separable components from the body 140 and may be made of a different material than the body 140, such as, e.g., one of the plastic materials or glass material described above.

Each window 220, 224 extends in a generally vertical direction parallel with the central axis 206 from a top edge 226 to a bottom edge 228 and in a generally lateral direction parallel with the lateral axis 210 from a front edge 230 to a rear edge 232. As shown in FIG. 3, the top edge 226 of the window 220 is positioned near the transition portion 172 and disposed at an angle, e.g., about 5 degrees, relative to the lateral axis 210 as it extends between the front edge 230 and the rear edge 232. It will be appreciated that the front edge 230 and the top edge 226 of the window 220 intersect at a point that is a distance H2 from the bottom end plane 217. Further, a viewing plane 236 is coplanar with the front end plane 216 and aligned with a portion of the front edge 230 of each window 220, 224, such that each window 220, 224 extends substantially rearward of the viewing plane 236.

Further, the bottom edge 228 extends from the rear edge 232 to the front edge 230 at an angle, e.g., about 5 degrees, and intersects the front edge 230 at a distance H3 from the bottom end plane 217. The front edge 230 and the rear edge 232 are substantially parallel with each other and extend generally vertically, both being substantially parallel with the central axis 206. The front edge 230 extends along the front end 160 of the sidewall 146 and follows a shape of the perimeter 184 of the front panel 130 and is at least partially located the depth D2 from the back plane 214. In some embodiments, the front edge 230 may be offset from the front end plane 216. The rear edge 232 extends between the top edge 226 and the bottom edge 228 and is spaced apart from the rear wall 148. In particular, the rear edge 232 is located a distance D3 from the back plane 214.

Referring to FIGS. 2-4, the window 220 extends in a generally vertical direction that is substantially parallel to and offset from the central plane 204. In the illustrated embodiment, the top edge 226 of each window 220, 224 follows the curvature of the sidewall 146 in that the top edge 226 is located closer to the central plane 204 than the bottom edge 228 as the sidewall 146 curves inwardly toward the top end 162 from the opposing sides 168, 170. Accordingly, the front edge 230 and the rear edge 232 are located different distances from the central plane 204, and the front edge 230 curves relative to the central plane 204 between the top edge 226 and the bottom edge 228. Similarly, the rear edge 232 curves relative to the central plane 204 between the top edge 226 and the bottom edge 228. In some embodiments, both of the windows 220, 224 may be offset an equal distance from the central plane 204.

It is contemplated that the windows 220, 224 may be sized and shaped differently in other embodiments. The windows 220, 224 may be tilted relative to the central plane 204 so that the front edge 230 is spaced farther from the central plane 204 than the rear edge 232, as illustrated in FIG. 3. Accordingly, the sidewall 146 is tapered between the front end 160 and the rear end 158, such that the sidewall 146 extends from the rear wall 148 at an angle relative to the central plane 204 and, in particular, the sidewall 146 may extend outwardly relative to the central plane 204 in a rear-to-front direction. In some embodiments, the windows 220, 224 may be sized and shaped differently from each other and located at different positions on the sidewall 146.

In the illustrated embodiment, the front panel 130 is bowed or curved. In some embodiments, the front panel 130 bows outwardly relative to the sidewall 146 and, in particular, the front panel 130 curves outwardly from the perimeter 184 to the midpoint 200 so that the depth D of the dispenser 110 is greater at a point along the central plane 204 than at a point spaced apart from the central plane 204. In this way, the depth D of the dispenser 110 varies in a side-to-side or lateral direction. As a result, the interior cavity 142 of the dispenser 110 also varies in depth to allow for ample space in which cartridges of varying capacity or type may be installed. Further, the curvature of the front panel 130 may prevent twisting of the cartridge 120 as it collapses within the interior cavity 142 during use, e.g., when a suction or vacuum pressure is applied, thereby maintaining alignment and positioning of the cartridge 120 with the windows 220, 224. Moreover, the curvature of the front panel 130 is substantially uniform in a vertical, top-to-bottom direction across the upper and lower sections 188, 192. The trigger 198 mimics the curvature of the front panel 130 to appear flush with the front wall 180. As best seen in FIG. 2, the depth D1 of the dispenser 110 is generally uniform in a vertical direction.

In the illustrated embodiment, the front panel 130 and the trigger 198 are generally provided as being opaque, having a VLT value of 5% or less, e.g., zero. The rear wall 148 of the body 140 is generally provided as being translucent, having a low to medium VLT value that is greater than the VLT value of the front panel 130, e.g., greater than 5%. The sidewall 146 of the body 140 includes several portions having different VLT values from each other and, preferably, VLT values that are greater than 5%. In the illustrated embodiment, the top end 162 and the transition portions 172 are generally provided as being translucent, having a low to medium VLT value. Further, the opposing sides 168, 170 are provided as being translucent, having a low to medium VLT value, between the top end 162 and the bottom end 164. The windows 220, 224 are provided as being transparent, having a high VLT value, and bordered on multiple sides by the translucent sidewall 146. That is, the windows 220, 224 have a different VLT value than the remainder of the sidewall 146 and, preferably, the windows 220, 224 have a greater VLT value than the rest of the sidewall 146. In some embodiments, the windows 220, 224 have a VLT value that is approximately double the VLT value of the rest of the sidewall 146, although other configurations are possible. Accordingly, the body 140 of the dispenser 110 has at least two VLT values that are different from each other and greater than 5%.

Further, the sidewall 146 includes a viewing portion 240 and an illuminating portion 244 that have different VLT values from each other and, more specifically, the viewing portion 240 has a higher VLT value than the illuminating portion 244. In the illustrated embodiment, the windows 220, 224 constitute the viewing portion 240 and the remainder of the sidewall 146 constitutes the illuminating portion 244, although other configurations are possible. In some embodiments, the illuminating portion 244 may include only the top end 162 and the transition portions 172 of the sidewall 146, or, alternatively, only the top end 162, or, alternatively, only the transition portions 172. In the illustrated embodiment, the illuminating portion 244 includes the opposing sides 168, 170 of the sidewall 146 that surround the windows 220, 224, the rear wall 148, and the bottom end 164. In particular, the illumination portion 244 is provided as being translucent, having a low to medium VLT value due, in part, to the materials used and the surface treatment applied, while the viewing portion is transparent, having a high VLT value.

Further, the illuminating portion 244 and the viewing portion 240 define different surface areas from each other. In the illustrated embodiment, the illuminating portion 244 defines a greater surface area than the viewing portion 240. However, in some embodiments, the illuminating portion 244 and the viewing portion 240 may define equal surface areas. The illuminating portion 244 defines a surface area that is less than a total surface area of the sidewall 146 but, preferably, greater than about 20% of the total surface area of the sidewall 146. In some embodiments, the illuminating portion 244 comprises at least 50% of the total surface area of the sidewall 146 and has a VLT value that is greater than 5% and less than the VLT value of the viewing portion 240.

In addition, the viewing portion 240 defines a surface area that is less than the total surface area of the sidewall 146 but, preferably, greater than about 20% of the total surface area of the sidewall 146. In the illustrated embodiment, the viewing portion 240 comprises at least 30% of the total surface area of the sidewall 146. It shall be appreciated that the viewing portion 240 includes each of the windows 220, 224 and, thus, the surface area of the viewing portion 240 is equal to the sum of the surface area of each window 220, 224. Further, the surface area of the viewing portion 240 is between about 20% and about 50% of the total surface area of the sidewall 146. In the illustrated embodiment of FIGS. 1-4, the viewing portion 240 does not include any apertures or openings formed therethrough, while the illuminating portion 244 includes the opening 174 (see FIG. 4) at the top end 162 of the sidewall 146, although other configurations are possible. In the illustrated embodiment, the windows 220, 224 are discrete and spaced apart from each other on the sidewall 146, and each have a VLT value that is greater than the VLT value of the illuminating portion 244, although other configurations are possible. In this way, a balance is struck between affording sufficient view of the cartridge 120 within the dispenser 110 and hiding the interior cavity 142 of the dispenser 110 from view.

Similarly, the front panel 130 of the dispenser 110 has a surface area that comprises at least about 20% and no more than about 50% of a total surface area of the dispenser 110. It shall be appreciated that the front wall 180 may have a surface area of between about 10% and about 50% of the total surface area of the dispenser 110. As a result, the front panel 130 is configured to conceal the interior cavity 142 and the cartridge 120 disposed therein. In this additional way, a balance is struck between affording sufficient viewing of the cartridge 120 within the dispenser 110 and hiding the interior cavity 142 of the dispenser 110 from view.

As illustrated in FIG. 4, a top down schematic view of the dispenser 110 is shown. In a first aspect, the illuminating portion 244, which in the illustrated embodiment comprises the top end 162 and transition portions 172 of the sidewall 146 as well as a thicker portion of the recessed section 166, are configured to allow ambient light (e.g., artificial or natural) to enter the interior cavity 142 but without permitting a view therein. In addition, the sidewall 146, particularly the opposing sides 168, 170 on which the windows 220, 224 are disposed, are depicted as having a curvature between the rear end 158 and the front end 160 in a front-to-rear direction, such that the sidewall 146 is narrower near the rear end 158 than the front end 160. Differently said, the sidewall 146 tapers or narrows inwardly from front-to-rear. As a result, the windows 220, 224, which correspond to the viewing portion 240 of the sidewall 146, are rotated or tilted relative to the central plane 204 away from the front panel 130, such that the rear edges 232 thereof are located closer to the central plane 204 than the front edges 230. It is contemplated that the sidewall 146 may taper or narrow in discrete sections, such as, e.g., at the bottom end 164, and other configurations are possible.

The front panel 130 and the viewing portion 240 are arranged such that multiple viewing zones are defined with respect to a user's vantage point relative to the dispenser 110 and, in particular, relative to the central plane 204. It will be appreciated that, as previously defined, the viewing plane 236 is aligned with a portion of the front edge 230 of each window 220, 224 that extends along the front end plane 216. As such, the viewing plane 236 is parallel with the lateral axis 210 and perpendicular to the central plane 204, as illustrated in the top down view of FIG. 4. Further, the viewing plane 236 is formed at an intersection between a part of the viewing portion 240 and a part of the illuminating portion 244. In one aspect, an actuation viewing zone 250 is defined adjacent the front panel 130 and extends radially between first and second boundaries 252, 254, which are imaginary boundaries schematically represented here for illustrative purposes. The first and second boundaries 252, 254 intersect the viewing plane 236 at the front edge 230 of each of the first and second windows 220, 224, thus, the first and second boundaries 252, 254 extend from the front edge 230 of each of the first and second windows 220, 224 at identical but mirrored angles θ, e.g., 30 degrees, from the viewing plane 236, as illustrated in the top-down view of FIG. 4. The angle θ is exemplary and corresponds to an approximate range of viewing perspective afforded by the windows 220, 224 themselves, which is a function of various characteristics of the windows 220, 224 that impact VLT and/or opacity, such as, e.g., surface treatment, material, coatings, abrasions, and the like. Additionally, the angle θ is limited by a viewing direction P1 of the first window 220, which is disposed orthogonally from the surface of the window 220, and a viewing direction P2 of the second window 224, which is disposed orthogonally from the surface of the second window 224. Accordingly, the viewing directions P1 and P2 are functions of the angle or curvature of the first window 220 and the second window 224. As such, when the viewing directions P1 and P2 change, e.g., by pivoting or rotating rearwardly or forwardly, the angle θ of the first and second boundaries 252, 254 also changes.

In the actuation viewing zone 250, viewing of the cartridge 120 housed in the interior cavity 142 of the dispenser 110 is prevented or inhibited by the opaque front panel 130. Preferably, a user within the actuation viewing zone 250 is actuating the trigger 198 to cause a fluid to be dispensed, rather than identifying the refill status. As a result, the actuation viewing zone 250 is configured to hide or conceal the cartridge 120 and interior cavity 142 of the dispenser 110 and, instead, to limit visibility to the opaque front panel 130.

Further, an assessment viewing zone is defined adjacent the body 140 of the dispenser 110. The assessment viewing zone includes a first assessment zone 260 near the first window 220 and a second assessment zone 262 near the second window 224. It will be appreciated that, as previously defined, the back plane 214 extends parallel with the lateral axis 210 and perpendicularly to the central plane 204, as illustrated in the top down view of FIG. 4. The first assessment zone 260 is defined between the first boundary 252 and a third boundary 266 that extends from the rear edge 232 of the first window 220 at an angle ϕ, e.g., 30 degrees, from the back plane 214, as illustrated in the top-down view of FIG. 4. Similarly, the second assessment zone 262 is defined between the second boundary 254 and a fourth boundary 268 that extends from the rear edge 232 of the second window 224 at an angle ϕ, e.g., 30 degrees, from the back plane 214, as illustrated in the top-down view of FIG. 4. As with the first and second boundaries 252, 254, the third and fourth boundaries 266, 268 are imaginary boundaries provided for illustrative purposes and mirror each other about the central plane 204. In addition, the angles ϕ are exemplary and correspond to the approximate range of viewing perspective afforded by the windows 220, 224 and the viewing directions P1 and P2, as described above.

Further, when the dispenser 110 is mounted to an external wall that is coplanar with the back plane 214, the first and second assessment zones 260, 262 may extend radially rearward from the first and second boundaries, respectively, to the external wall. However, when the dispenser 110 is mounted to an external support, such as, e.g., a free-standing mount, the first and second assessment zones 260, 262 may extend radially rearward beyond the back plane 214.

In some aspects, the first and second assessment zones 260, 262 are provided for viewing of the cartridge 120 and the interior cavity 142 of the dispenser 110 through, at least, the first and second windows 220, 224, respectively. As mentioned above, light is permitted to enter through illuminating portion 244 of the sidewall 146 to illuminate the interior cavity 142 and the cartridge 120, and the transparent viewing portions 240 are provided to allow a maintenance professional standing or moving within the first or second assessment zone 260, 262 to see the cartridge 120 and the interior cavity 142. In the illustrated embodiment, both the illuminating portion 244, e.g., the sidewall 146, and the viewing portion 240, e.g., the windows 220, 224, are disposed within the first and second assessment zones 260, 262, such that two VLT values are disposed within the first and second assessment zones 260, 262. Preferably, a maintenance professional within the first or second assessment zone 260, 262 is able to quickly, i.e., with a glance, identify a refill status of the dispenser 110. Thus, maintenance professionals will seek out the first or second assessment zone 260, 262 to determine whether to refill the dispenser 110, rather than standing within the actuation viewing zone 250 or opening the dispenser 110.

Still referring to FIG. 4, the dispenser 110 is schematically represented from a top plan view as being circumscribed by a circumference 274, i.e., 360 degrees, about the dispenser 110, with the central plane 204 intersecting the circumference 274 at 0 degrees. As indicated, the first boundary 252 intersects the circumference 274 at 60 degrees and the second boundary 254 intersects the circumference 274 at 300 degrees. Thus, the actuation viewing zone 250 extends approximately 120 degrees about the dispenser 110. In addition, the third boundary 266 intersects the circumference 274 at 120 degrees and the fourth boundary 268 intersects the circumference 274 at 240 degrees. As a result, the first and second assessment zones 260, 262 each extend approximately 60 degrees about the dispenser 110.

It is contemplated that by further narrowing or tapering the sidewall 146 of the body 140 inwardly toward the rear end 158, the third boundary 266 of the first window 220 and the fourth boundary 268 of the second window 224 will correspondingly rotate rearward so as to change the viewing directions P1 and P2, in turn causing the first and second boundaries 252, 254 to rotate so that the associated angle θ decreases, thereby expanding the actuation viewing zone 250. Likewise, the third and fourth boundaries 266, 268 rotate rearward so that the associated angle ϕ increases relative to the back plane 214. As such, the first and second assessment zones 260, 262 will become rotated in a rearward direction while the actuation viewing zone 250 grows wider, e.g., greater than 120 degrees. Alternatively, the sidewall 146 may not include a taper between the front end 160 and the rear end 158. Further, the sidewall 146 may be tapered in the opposite direction. It is further contemplated that the actuation viewing zone 250 may be widened by extending the perimeter 184 of the front panel 130 farther outwardly, i.e., away from the central plane 204, than the sidewall 146 to overlap or protrude beyond the sidewall 146. Alternatively, the actuation viewing zone 250 may be increased by offsetting a part of or the entirety of the windows 220, 224 rearwardly toward the back plane 214, particularly so that the front edges 230 are spaced apart from the front end plane 216 and, thus, the viewing plane 236 is spaced rearwardly from the front end plane 216. By doing so, the first and second boundaries 252, 254 are moved rearwardly, such that the first boundary 252 intersects the circumference 274 at a point greater than 60 degrees and the second boundary 254 intersects the circumference at a point less than 300 degrees.

In some embodiments, an interior of the rear wall 148 and/or the front wall 180 may include a reflective material for reflecting visible light passed through the sidewall 146. The reflective material may be integrally provided with the rear wall 148 or the front wall 180, or, the reflective material may be applied thereto, such as, e.g., by reflective adhesive, reflective coating or paint, or a reflective panel. The reflective material may reflect the visible light back into the interior cavity 142 of the dispenser 110 to enhance illumination of any cartridge 120 or fluid disposed therein. The reflective material may be advantageous where the dispenser 110 is placed in environments having low amounts of visible light, whether intentionally or not. For example, in washrooms provided as part of a park or campsite, there may be little to no artificial light provided and, instead, only ambient light from the sun or light reflected off of the moon may be directed into the washroom. In another example, washrooms in various entertainment venues, restaurants, bars, sports arenas, and the like may be intentionally provided a low amount of visible light for ambiance, aesthetics, or energy-conservation purposes. Accordingly, the dispenser 110 is designed to accommodate a variety of environments having a range of visible light afforded to them, which may be further enhanced by the addition of reflective material to the rear wall 148 or the front wall 180.

Figure 5:
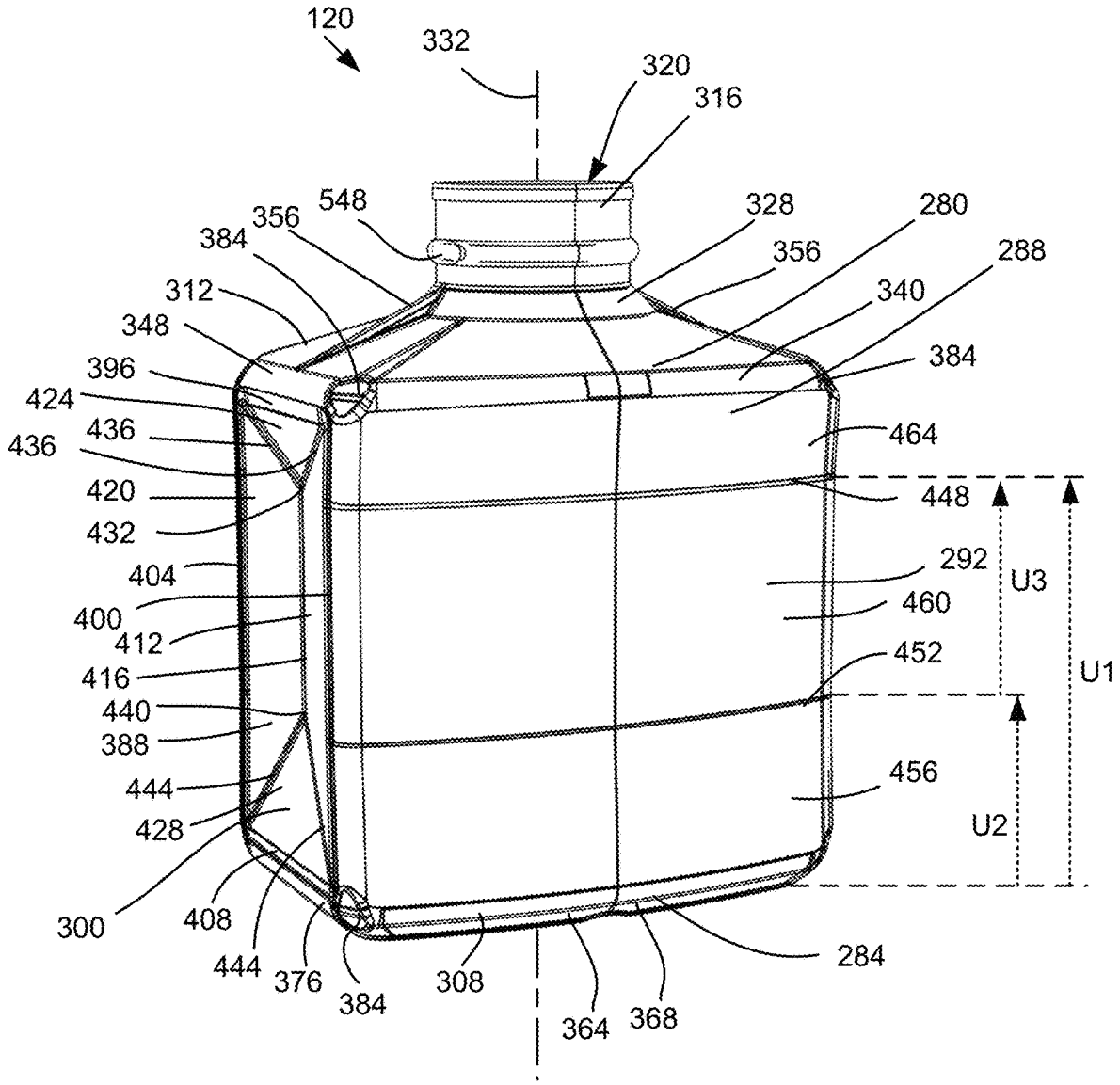
FIG. 5 is a perspective view of a cartridge of the dispenser assembly of FIGS. 1-4.
Figure 6:
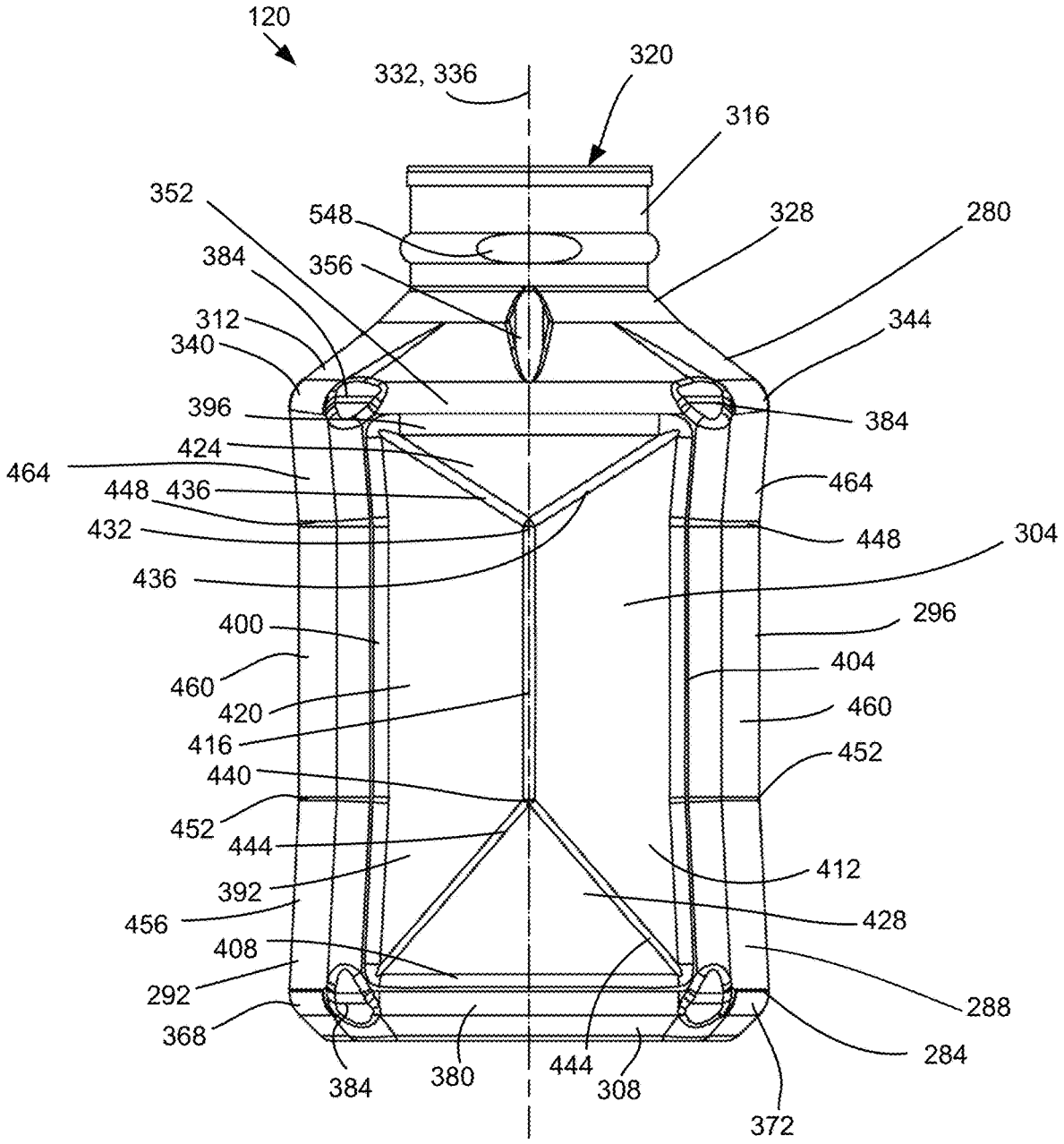
FIG. 6 is a side elevational view of the cartridge of FIG. 5.
Figure 7:
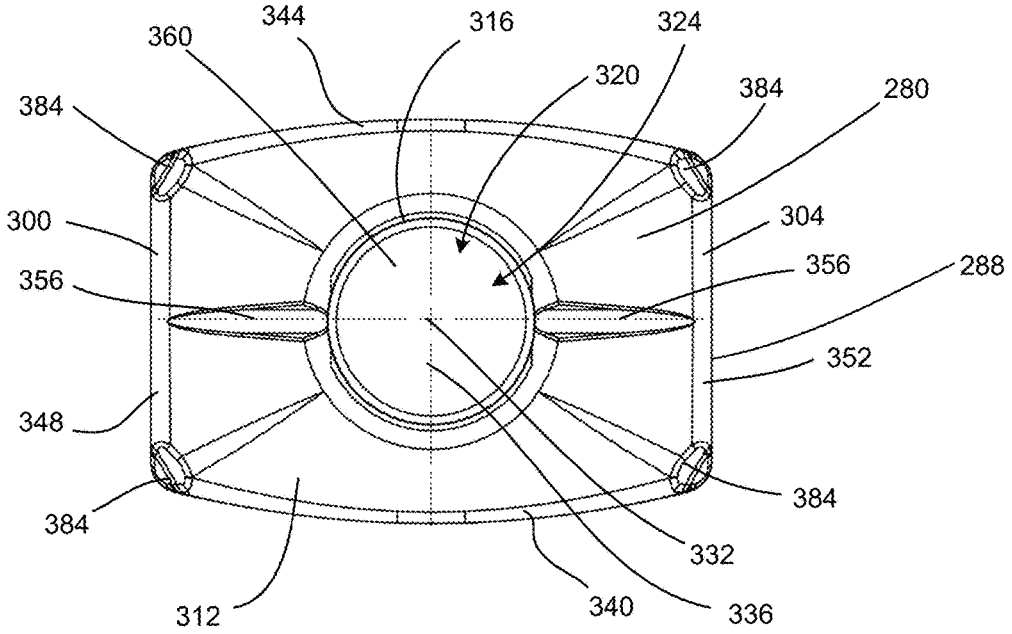
FIG. 7 is a top plan view of the cartridge of FIG. 5.

Referring to FIGS. 5-7, the cartridge 120 includes an outlet end 280 and a base end 284 that is opposite the outlet end 280. The cartridge has a body 288 that includes a front side or front wall 292 opposite a rear side or rear wall 296, opposing first and second side walls 300, 304, and a base 308 from which the front and rear walls 292, 296 and the first and second side walls 300, 304 extend to a shoulder 312. The base 308 is located at the base end 284, the shoulder 312 is located at the outlet end 280, and the body 288 extends from the base end 284 to the outlet end 280. Differently said, the body 288 extends between the base 308 at the base end 284 and the shoulder 312 at the outlet end 280. The first and second side walls 300, 304 may be referred to collectively as a pair of side walls. In the illustrated embodiment, the cartridge 120 is provided as being as being opaque, having a low VLT value of 5% or less. In other embodiments, the cartridge 120 may be partially or entirely translucent or transparent, having a VLT value greater than 5%.

A generally cylindrical neck 316 extends axially from a central location of the shoulder 312 to define an open mouth 320 into and in communication with an inner volume 324 of the cartridge 120. An annular collar 328 extends about the neck 316. The base 308 is disposed opposite the neck 316 of the cartridge 120 and the inner volume 324 of the cartridge 120 is generally defined between the front and rear walls 292, 296, the first and second side walls 300, 304, and between the neck 316 and the base 308. The neck 316 and annular collar 328 are generally rigid and/or thickened relative to the body 288 of the cartridge 120 and, thus, resist deformation during collapse, provide support when inverted and installed within the dispenser 110, and afford a secure fit with the pump assembly 152 that is operably attached to the neck 316. A vertical axis 332 that defines a vertical plane 336 extends centrally through the cartridge 120 between the first and second side walls 300, 304 and intersects the front wall and the rear wall 292, 296. In other words, the vertical plane bisects the cartridge 120 and the cartridge 120 is structurally symmetrical with respect to the vertical plane 336. Further, the front and rear walls 292, 296 bow or curve outwardly relative to the vertical axis 332 between the first and second side walls 300, 304.

Still referring to FIGS. 5-7, the shoulder 312 extends at an angle from the neck 316 to each of the front wall, the rear wall 292, 296, and the pair of side walls 300, 304. In particular, a front shoulder edge 340 is formed where the shoulder 312 meets the front wall 292, a rear shoulder edge 344 is formed where the shoulder 312 meets the rear wall 296, a first shoulder edge 348 is formed where the shoulder 312 meets the first side wall 300, and a second shoulder edge 352 is formed where the shoulder 312 meets the second side wall 304. A pair of support ribs 356 extend along the shoulder 312 between the neck 316 and the pair of side walls 300, 304. In one instance, each support rib 356 extends from the annular collar 328 to each of the pair of side walls 300, 304. Each support rib 356 protrudes a varying distance from the shoulder 312, such that each support rib 356 protrudes a greater distance from the shoulder 312 near the neck 316 than near the respective first and second shoulder edges 348, 352. In other words, each support rib 356 grows taller relative to the shoulder 312 moving in an inward direction relative the vertical axis 332. The support ribs 356 are provided to resist deformation of the shoulder 312 in the outlet end 280 of the cartridge 120 while collapsing during use. It is contemplated that the support ribs 356 are hollow and open to the interior of the cartridge 120, but other configurations are possible.

Figure 10:
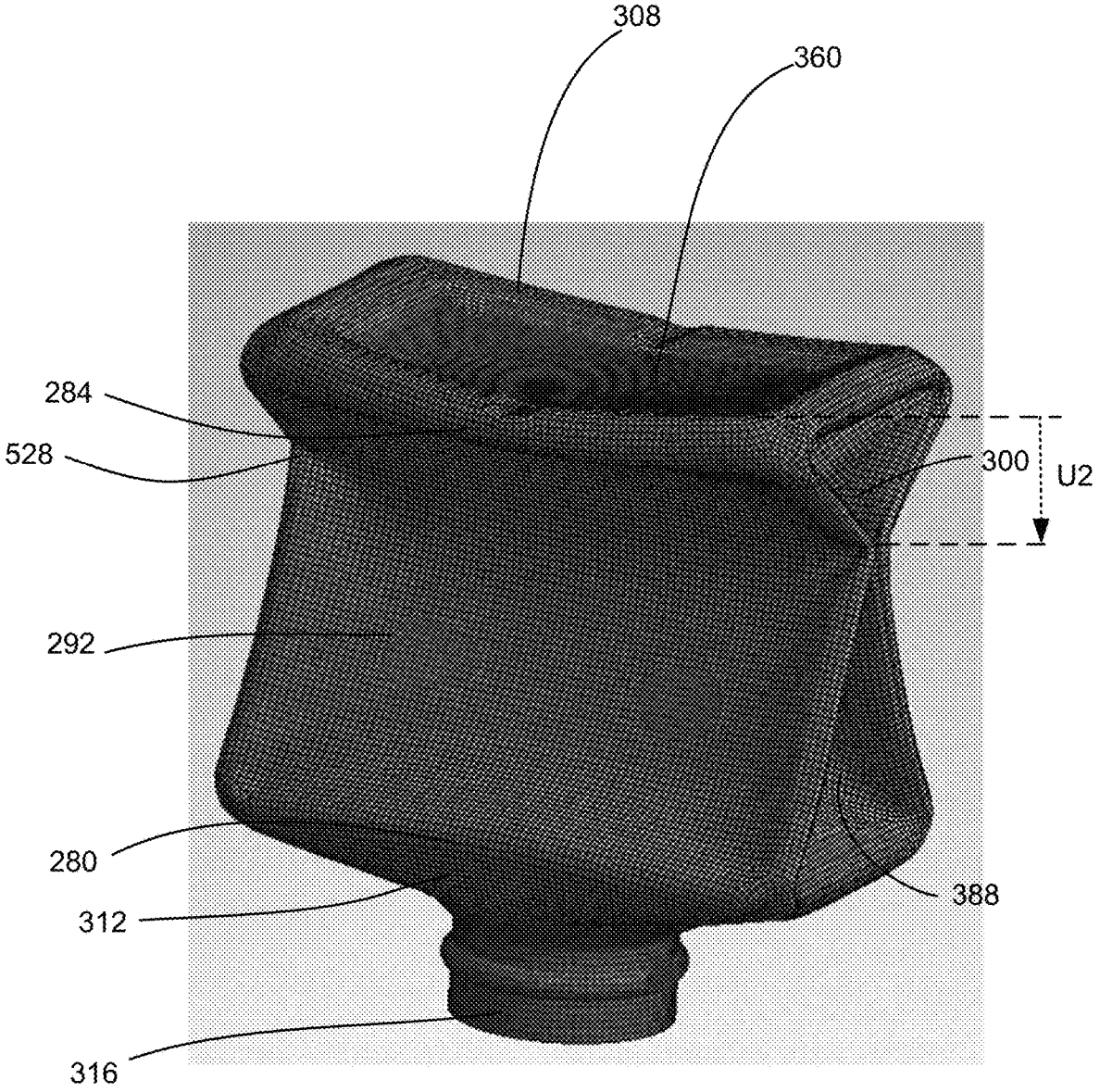
FIG. 10 is a schematic representation of the cartridge of FIG. 5, where the cartridge is depicted as being inverted and in a collapsed configuration.
Figure 11:
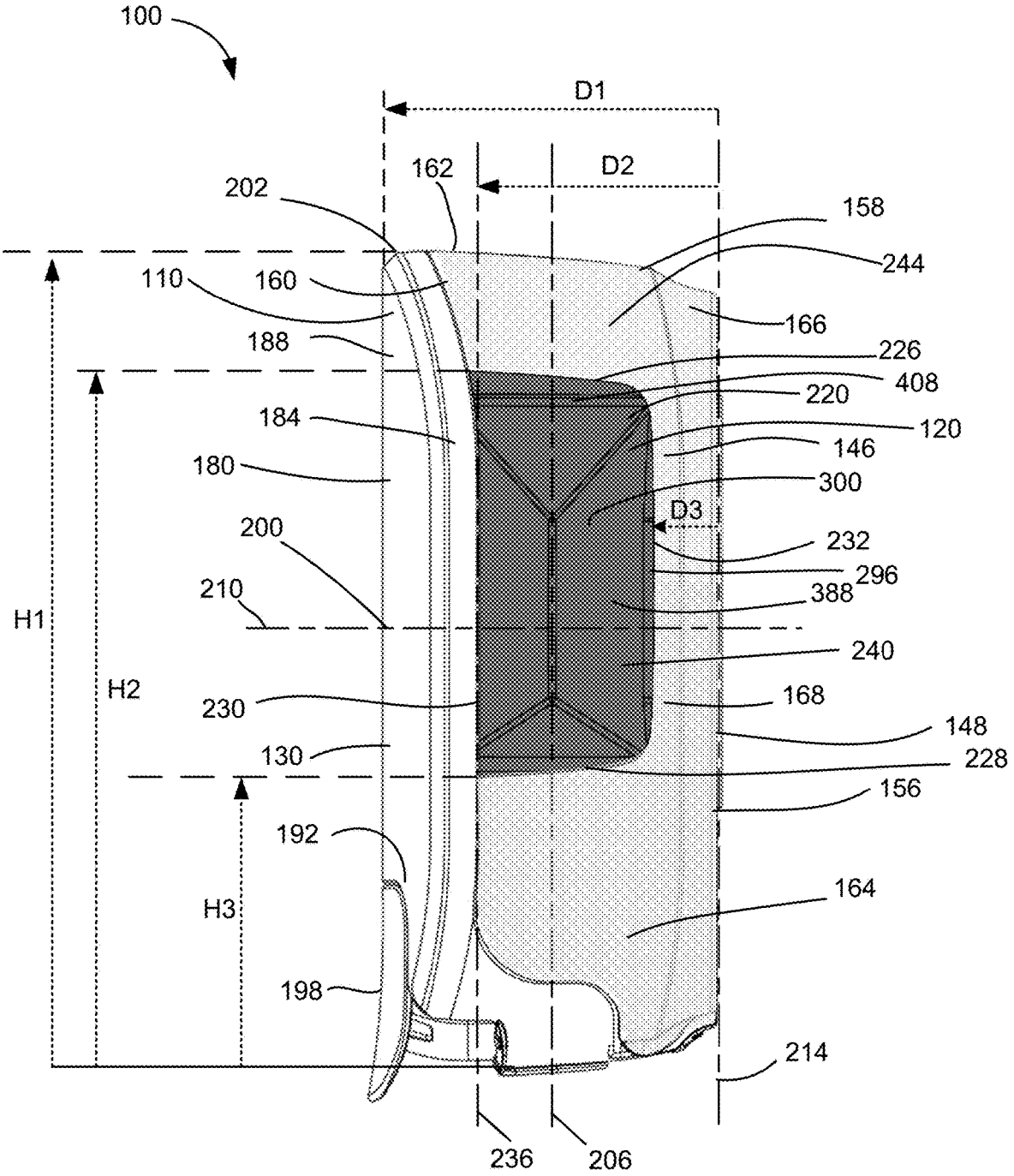
FIG. 11 is a side elevational view of the dispenser assembly of FIG. 1 in a closed configuration, where a body of the dispenser assembly is depicted as including transparent and translucent portions, and where the cartridge of FIG. 5 is shown through the transparent portion of the dispenser assembly.

Referring to FIGS. 7 and 10, the base 308 includes a generally planar floor 360 that is surrounded by a base edge 364. Further, as illustrated in FIGS. 5-7, a front base edge 368 is formed where the base 308 meets the front wall 292, a rear base edge 372 is formed where the base 308 meets the rear wall 296, a first base edge 376 is formed where the base 308 meets the first side wall 300, and a second base edge 380 is formed where the base 308 meets the second side wall 304. The floor 360 and the base edge 368 resists deformation when collapsing to prevent fluid from becoming trapped in the cartridge 120. Further, the floor 360 and the base 308 are stabilized and/or thickened relative to the body 288 of the cartridge 120 for additional support and rigidity, such as when the cartridge 120 is stored upright on the base 308, or during shipping or transit.

In the illustrated embodiment, a plurality of flattened corners 384 are disposed in the outlet end 280 between each of the front, rear, first, and second shoulder edges 340, 344, 348, 352 and in the base end 284 between each of the front, rear, first, and second base edges 368, 372, 376, 380. Preferably, the flattened corners 384 are provided without a radius of curvature, or with a large radius of curvature, relative to the vertical axis 332 to prevent fluid from becoming trapped within the cartridge 120 and, thus, increase the percentage of fluid dispensed from the cartridge 120.

Further, the first side wall 300 and the second side wall 304 each carry a respective first and second valley 388, 392. Each of the first valley 388 and the second valley 392 is bordered by a top peripheral edge 396, a front peripheral edge 400, a rear peripheral edge 404, and a bottom peripheral edge 408. A fore panel 412 extends inwardly from the front peripheral edge 400 toward a vertical fold line 416, an aft panel 420 extends inwardly from the rear peripheral edge 404 to the vertical fold line 416, an upper panel 424 extends inwardly from the top peripheral edge 396 to the vertical fold line 416, and a lower panel 428 extends inwardly from the bottom peripheral edge 408 to the vertical fold line 416. The vertical fold line 416 is located closer to the vertical plane 336 than the top, front, rear, and bottom peripheral edges 396, 400, 404, 408. Further, the vertical fold line 416 extends between an upper junction 432 that is connected to an upper pair of angled fold lines 436 and a lower junction 440 that is connected to a lower pair of angled fold lines 444. The upper panel 424 extends between the upper pair of angled fold lines 436, the lower panel 428 extends between the lower pair of angled fold lines 444, and the upper panel 424 defines a surface area that is less than a surface area of the lower panel 428. However, the fore panel 412 and the aft panel 420 define approximately equal surface areas. Both the upper panel 424 and the lower panel 428 are generally triangular-shaped, and both the fore panel 412 and the aft panel 420 are generally trapezoidal-shaped, although other configurations are possible. The upper junction 432 is located closer to the top peripheral edge 396 than the lower junction 440 is located to the bottom peripheral edge 408.

With continued reference to FIGS. 5-7, the front wall 292 and the rear wall 296 each include an upper crease 448 and a lower crease 452 that each extend laterally between the opposing side walls 300, 304. The upper crease 448 is positioned closer to the outlet end 280, e.g., an upper distance U1 from the base 308, and the lower crease 452 is positioned closer to the base end 284, e.g., a lower distance U2 from the base 308. Further, the upper and lower creases 448, 452 are spaced apart from each other an intermediate distance U3 that is less than the upper distance U1 and greater than the lower distance U2. The lower distance U2 is less than the upper distance U1. Further, the upper and lower creases 448, 452 correspond to the upper and lower junctions 432, 440 of the pair of side walls 300, 304. A lower subpanel 456 is provided between the base 308 and the lower crease 452 on each of the front and rear walls 292, 296. An intermediate subpanel 460 is provided between the upper and lower creases 448, 452 on each of the front and rear walls 292, 296. An upper subpanel 464 is provided between the upper crease 448 and the shoulder 312 on each of the front and rear walls 292, 296. The upper and lower subpanels 464, 456 are angled toward the intermediate subpanel 460 in opposite directions to each other, but the intermediate subpanel 460 is generally parallel with the vertical axis 332.

The upper and lower creases 448, 452 of the front wall 292 and the rear wall 296, and the fold lines 416, 436, 444 of the side walls 300, 304 are arranged in a pattern that is offset from an even spacing along a height of the cartridge body 140 in a direction toward the outlet end 280 and/or the shoulder 312. It will be appreciated that a representative cartridge 520 is depicted in FIGS. 12-17, which illustrates this offset distribution of crease lines along the height of a cartridge body 524 and the shape in which the cartridge 120 collapses. The offset crease lines are located toward the outlet end 280 to prevent fluid from becoming trapped inside and, thus, not dispensed. Further, the upper and lower creases 448, 452 and the fold lines 416, 436, 444 of the side walls 300, 304 are configured to prevent twisting or rotation of the cartridge 120 during collapse.

As shown in FIG. 10, which schematically depicts the cartridge 120 in a collapsed state for illustrative purposes, a waist 528 is formed where the front wall 292 and the rear wall 296 converge toward each other and, in some instances, come in contact with one another. The waist 528 is positioned substantially closer to the base 308 than the shoulder 312, e.g., approximately ⅓ of the distance between the base 308 and the shoulder 312, approximately the distance U2 from the base 308. Because the cartridge 120 is inverted during use in the dispenser 110, the waist 528 being positioned closer to the base end 308 allows greater proportions of fluid to be dispensed, thereby preventing waste and increasing a total percentage of fluid dispensed from the cartridge 120. Further, it will be appreciated that the base 308, flattened corners 384, shoulder 312, and neck 316 are generally undeformed in the collapsed state of the illustrated embodiment, thereby preventing fluid from becoming trapped inside the cartridge 120. However, as illustrated in FIG. 10, some amount of deformation, e.g., warping or bending, may occur in the base 308 or the shoulder 312 without departing from the scope of this disclosure.

In some embodiments, the cartridge 120 is composed of a plastic material, although other materials may be used, such as, e.g., metals, alloys, composites, biodegradable materials, recycled materials, natural materials, among others. Further, the cartridge 120 can be manufactured by a blow-molding process, although other manufacturing methods are contemplated depending partly on the material used, such as, e.g., injection molding, thermoforming, welding, 3D printing and/or additive manufacturing, among others. Further, in some embodiments a label is affixed to the cartridge 120, preferably on the front wall 292 or the rear wall 296. The label may display information regarding the fluid within the cartridge 120, branding and/or marketing information, cartridge types and/or compatibility, and a variety of other suitable and pertinent information. The label may be coupled to the cartridge 120 using an adhesive, fasteners, or other joining techniques. Alternatively, the label or information may be integrally formed with the cartridge 120.

Figure 8:
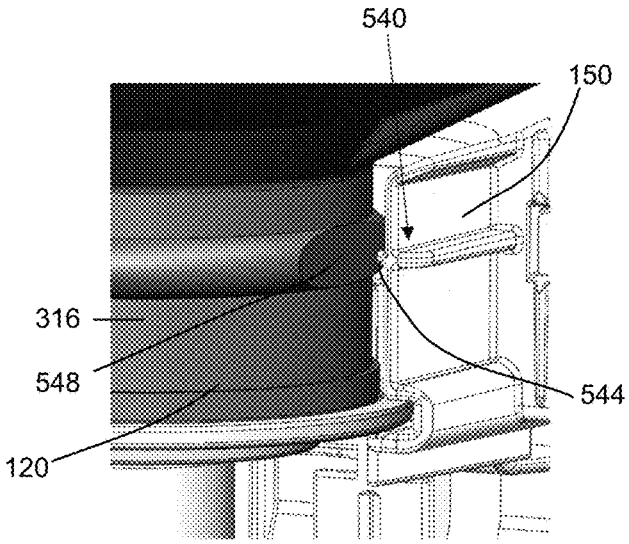
FIGS. 8 and 9 are partial, enlarged views of the neck of the cartridge of FIG. 5 being received by the dispenser assembly.
Figure 9:
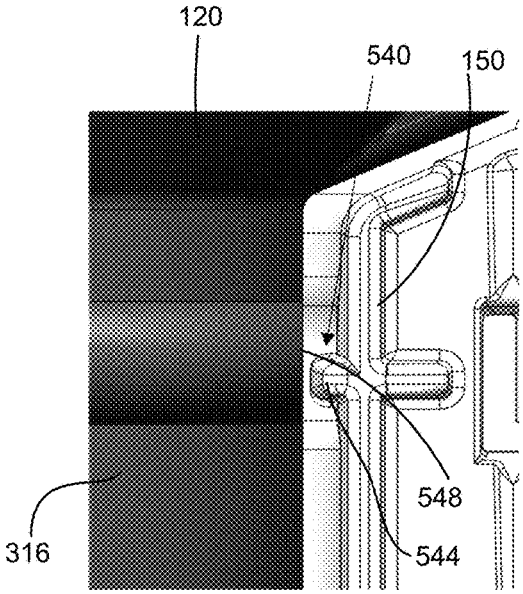

With reference to FIGS. 8 and 9, the dispenser 110 includes a support structure 540 including the collar 150 with opposing guide projections 544 that are configured to interact with the neck 316 of the cartridge 120 when installed therein. In the illustrated embodiment, the cartridge 120 includes corresponding flat portions 548 that correspond to the guide projections 544 of the collar 150, thereby allowing the cartridge 120 to be received and installed in one or more predetermined orientations.

FIGS. 12-17 schematically illustrate a predetermined manner of collapse of the cartridge 520 at various refill states when viewed in side profile from the viewing portion 240, e.g., the window 220, as the amount of fluid in the representative cartridge 520 depletes from 100% full to 80% full, to 60% full, to 40% full, to 20% full, and to empty or substantially empty. The cartridge 520 of FIGS. 12-17 is representative of the cartridge 120 of FIGS. 5-7, therefore like elements are labelled as such. Further, the cartridge 520 shares many of the attributes and features of the cartridge 120, and the description of the cartridge 520 below is intended to be inclusive of the cartridge 120 for purposes of arrangement and visual indication.

Figure 12:
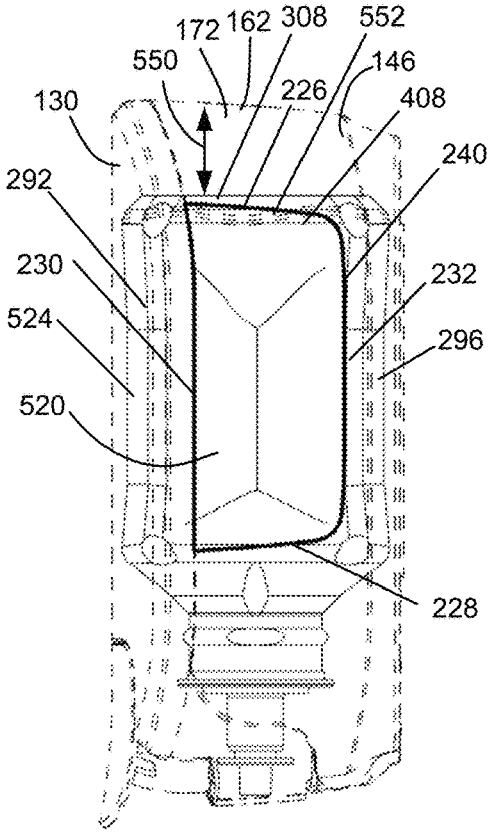
FIGS. 12-17 are side elevational schematic representations of the dispenser assembly of FIG. 1, where portions of the dispenser assembly are shown in dashed lines, transparent windows are shown in solid lines, and a representation of a cartridge is shown in solid lines, the dispenser assembly being illustrated in several states corresponding to a refill status of the cartridge.
Figure 17:
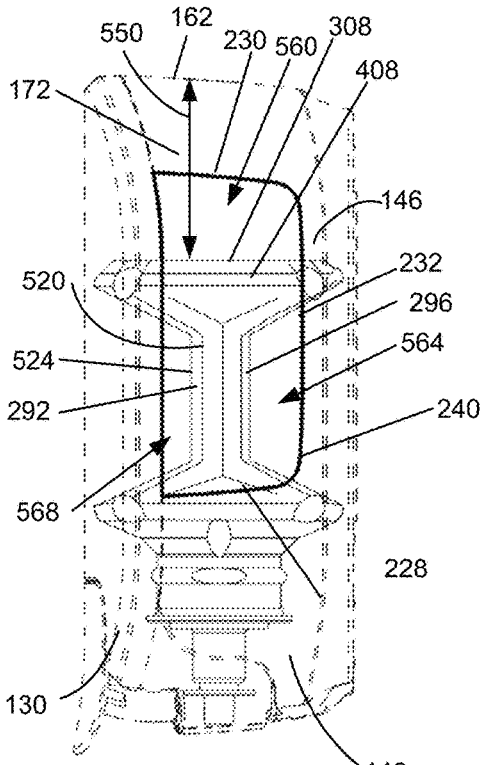

As illustrated in FIG. 12, the interior cavity 142 of the dispenser 110 defines a volume that is at least partially filled by the cartridge 520. In some examples, the cartridge 520 occupies at least about 60% of the total volume when the cartridge 520 is full. An unobstructed headspace 550 of the interior cavity 142 is defined between the cartridge 520 and the top end 162 of the sidewall 146 and also between the transition portions 172, as shown in FIG. 12. Therefore, the headspace 550 is exposed to the translucent portions, i.e., the illuminating portion, of the sidewall 146 when the cartridge 520 is full. The headspace 550 comprises at least about 5% of the total volume of the interior cavity 142 when the cartridge 520 is full. Then, as the base 308 of the cartridge 520 moves down, away from the top end 162 of the sidewall 146 due to the collapse of the cartridge 520 during use, the headspace 550 expands and, thus, more of the interior cavity 142 becomes unobstructed. As a result, light entering through the illuminating portion 244 of the sidewall 146 fills more of the unobstructed headspace 550 to intensify the illumination of the partially or fully collapsed cartridge 520 and, in some instances, the fluid level within through the cartridge 520. As the cartridge 520 collapses and occupies less of the interior cavity 142, more light fills the interior cavity 142 above and around the cartridge 520. In this way, the dispenser 110 is designed for even greater illumination of the cartridge 520 as it collapses, with the greatest amount of illumination provided when it is needed most, i.e., when the cartridge 520 is nearly empty, as shown in FIG. 17.

Referring to FIGS. 12-17, as the amount of fluid in the cartridge 520 is depleted, a fluid fill level 552 moves progressively toward the neck 316 of the cartridge 520. When the cartridge 520 is formed of a transparent or translucent material, the first and second windows, corresponding to the viewing portion 240 of the dispenser 110, are configured so that a fluid fill level 552 of the cartridge 520 is visible therethrough. In particular, the fluid fill level 552 moves progressively from the top edge 226 of the first window 220 toward the bottom edge 228. Such a visual indication of the fluid fill level 552 can be understood universally, without regard to any particular language.

In the illustrated embodiment of FIG. 12, when the fluid fill level 552 is aligned with or proximate the top edge 226 of the first window 220, this indicates that the cartridge 520 is 100% full or approximately full. In other embodiments, this can correspond to the cartridge 120 being in a state of 20% full, 40% full, 60% full, or 80% full. In the illustrated embodiment, when the fluid fill level 552 is aligned with or proximate the bottom edge 228, this indicates that the cartridge 520 is empty or near empty.

Still referring to FIG. 12, when the cartridge 120 is full, the bottom peripheral edge 408 is substantially aligned with and proximate the top edge 226 of the first window 220, being partially hidden or concealed behind the translucent sidewall 146 that surrounds the first window 220. Similarly, the front wall 292 and the rear wall 296 are located farther forward and rearward, respectively, than the respective front edge 230 and rear edge 232 of the first window 220, thus being hidden and are not visible through the window 220.

Figure 13:
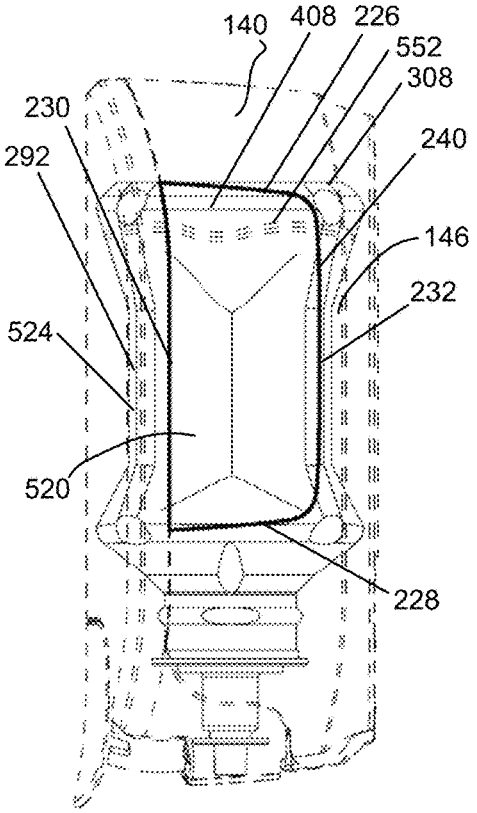

In another aspect, a visual cue or indicator is provided by the relative position of each window 220, 224 with respect to the cartridge 520 and portions thereof, that are visible. Referring to FIG. 13, when the cartridge 520 is in a state of approximately 80% full, the cartridge 520 has become partially collapsed and, thus, the bottom peripheral edge 408 has moved downwardly and the front and rear walls 292, 296 have moved toward each other, inwardly. Such movements are noticeable relative to the top edge 226, front edge 230, and rear edge 232 of the first window 220. In this manner, regardless of whether the cartridge 520 is opaque, translucent, or transparent, the fill status of the cartridge 520 may be determined in relation to the deformation of the cartridge 520 compared to portions of the first window 220.

Figure 14:
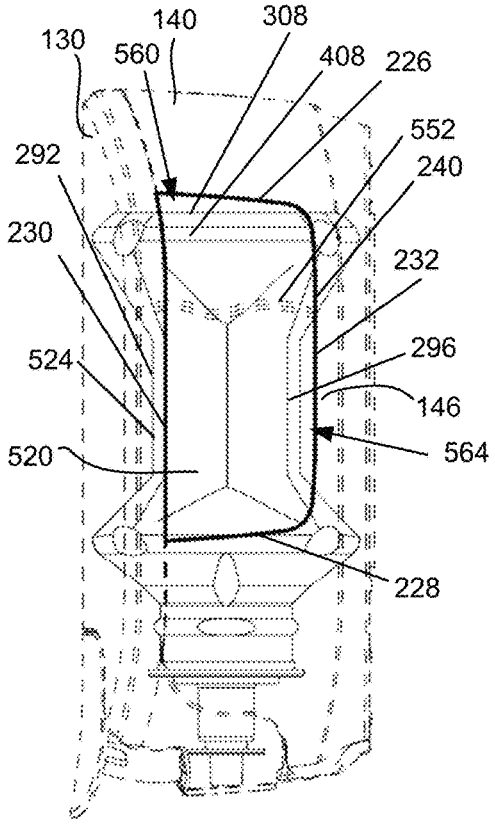

Referring to FIG. 14, when the cartridge 520 is in a state of being approximately 60% full, the collapse lowers the bottom peripheral edge 408 substantially farther as compared to the full state. Accordingly, the base 308 of the cartridge 520 is now visible through the first window 220 below the top edge 226 and a gap representing an upper visual cue 560 is defined between the top edge 226 and the base 308 of the partially collapsed cartridge 520. Similarly, the rear wall 296 has moved inwardly toward the front wall 292 to become visible through the first window 220 and a gap representing a rear visual cue 564 is defined between the rear edge 232 and the rear wall 296 of the cartridge 520. In this state, however, the front wall 292 of the cartridge 520 remains hidden. Accordingly, when approximately 60% full, the two visual cues 560, 564 are provided by the relative position of the cartridge 520 and the first window 220. It will be appreciated that as the cartridge 520 collapses from the state of 80% full to 60% full, e.g., depicted in FIGS. 13 and 14, respectively, at least one, but no more than the two, of the visual cues 560, 564, are visible through the first window 220. Differently said, as the cartridge 520 collapses from the full state to a partially full state, e.g., 60%, at least one, but no more than two, of the front wall 292, the rear wall 296, and the base 308 are visible through the first window 220.

Figure 15:
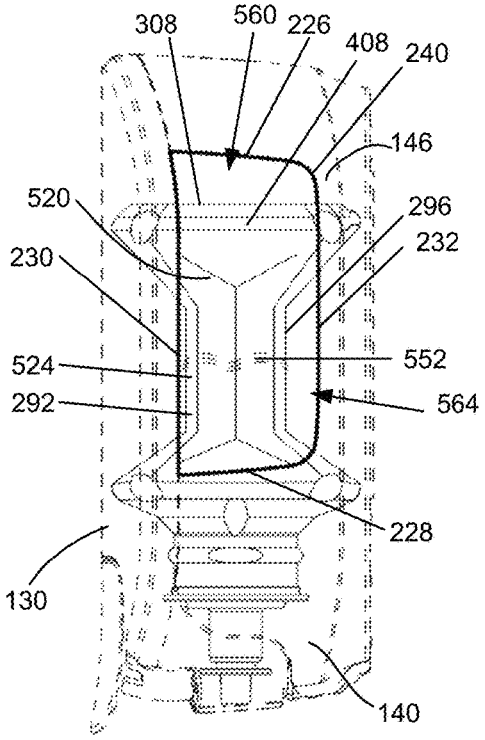
Figure 16:
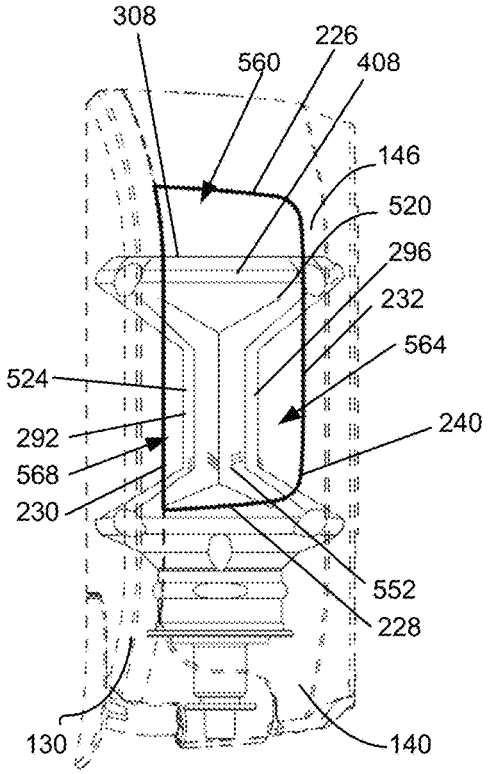

Referring now to FIG. 15, when the cartridge 520 is in a state of being approximately 40% full, the cartridge 520 has collapsed substantially, thereby enlarging the upper and rear visual cues 560, 564. In addition, a front visual cue 568 is provided in the form of a gap between the front wall 292 of the cartridge 520 and the front edge 230 of the first window 220, now that the front wall 292 has become at least partially visible through the first window 220. Accordingly, when the cartridge 520 is approximately 40% full, three visual cues 560, 564, 568 are provided by the relative position of the cartridge 520 and the first window 220. Differently said, when the cartridge 520 collapses to the state of 40% full, the front wall 292, the rear wall 296, and the base 308 are visible through the first window 220. For the sake of conciseness, it will be appreciated that these three visual cues 560, 564, 568 become increasingly enlarged as the cartridge 520 collapses to the 20% full state shown in FIG. 16, and to the empty state shown in FIG. 17.

Accordingly, the visual cues 560, 564, 568 are universally recognized and understood as corresponding to a refill status, in addition to or in lieu of the fluid fill level 552. As such, the visual cues 560, 564, 568 are not limited by language or other communication barriers that may vary among maintenance professionals. In this way, the dispenser 110 and the cartridge 120, 520 are adapted to be compatible in any country or region, worldwide.

It is further contemplated that the cartridge 120, 520 and/or the dispenser 110 may be provided with markings, indicia, colors and/or contrasting colors, and other visual indicators for facilitating the identification of the refill status by maintenance professionals. It is further contemplated that the windows 220, 224 may be tinted to filter or interact with a color or texture of the cartridge 120, 520 to enhance or highlight visibility of the refill status therein.

In some embodiments, the windows 220, 224, or portions thereof, may be provided with magnification to improve visibility of the fluid fill level 552, the cartridge 120, 520, and/or any characteristics associated with the fluid itself, from a longer distance or simply to allow for easier visualization when standing or moving within the assessment zones 260, 262. The magnification may be 2×, 3×, 4×, 10×, 50×, or any other suitable magnitude.

In addition, it is contemplated that the windows 220, 224 and/or the sidewall 146 may be provided with a texture or pattern on an inside and/or outside surface to further limit or narrow visibility through the windows 220, 224 from the assessment zones 260, 262. For example, anticipating that the dispenser 110 may be mounted near a mirror, such as in a washroom, the windows 220, 224 may be textured to prevent visibility of the cartridge 120, 520, fluid fill level 552, and interior cavity 142 through the reflection in the mirror. In some instances, a coating or substrate may be applied to the viewing portions 240, i.e., the windows 220, 224, to diffuse or scatter light propagated toward the viewing portion 240 at particular angles. For example, the coating or substrate may be provided to narrow the first and second assessment viewing zones 260, 262, or to prevent visibility through the mirror reflection when the dispenser 110 is positioned adjacent to or between mirrors.

Figure 18:
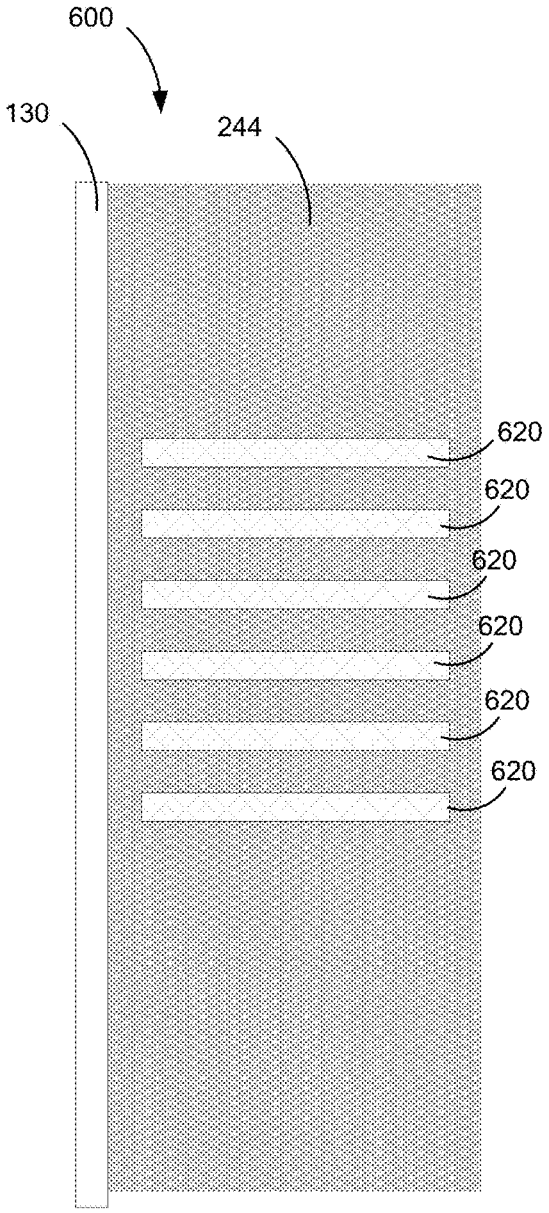
FIG. 18 is a schematic representation of another embodiment of a body of a dispenser assembly having multiple transparent and translucent portions.
Figure 19:
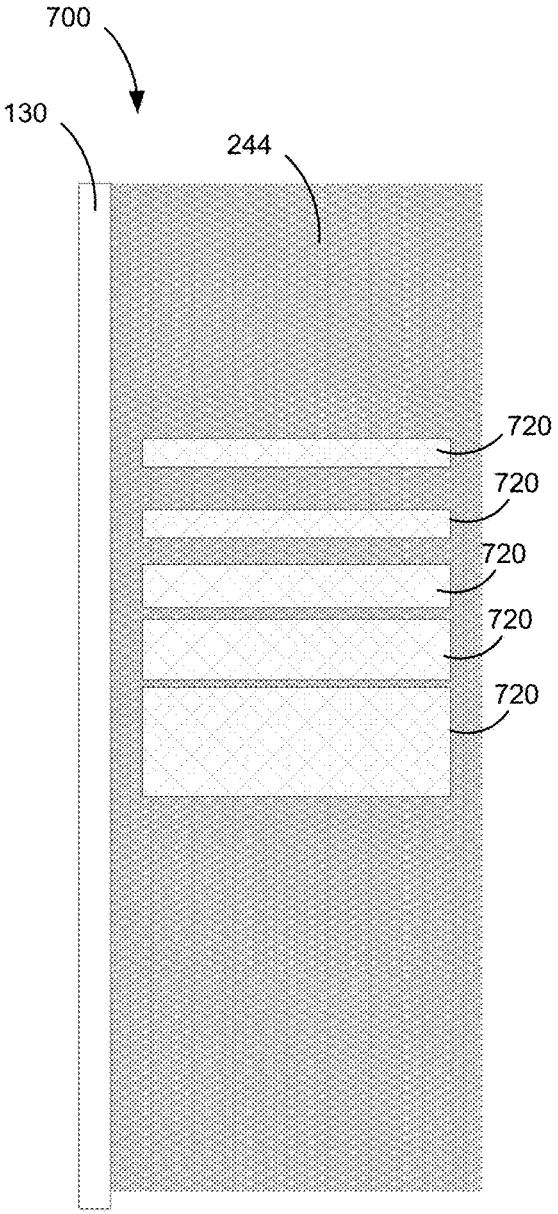
FIG. 19 illustrates a schematic representation of yet another embodiment of a body of a dispenser assembly having multiple transparent and translucent portions.
Figure 20:
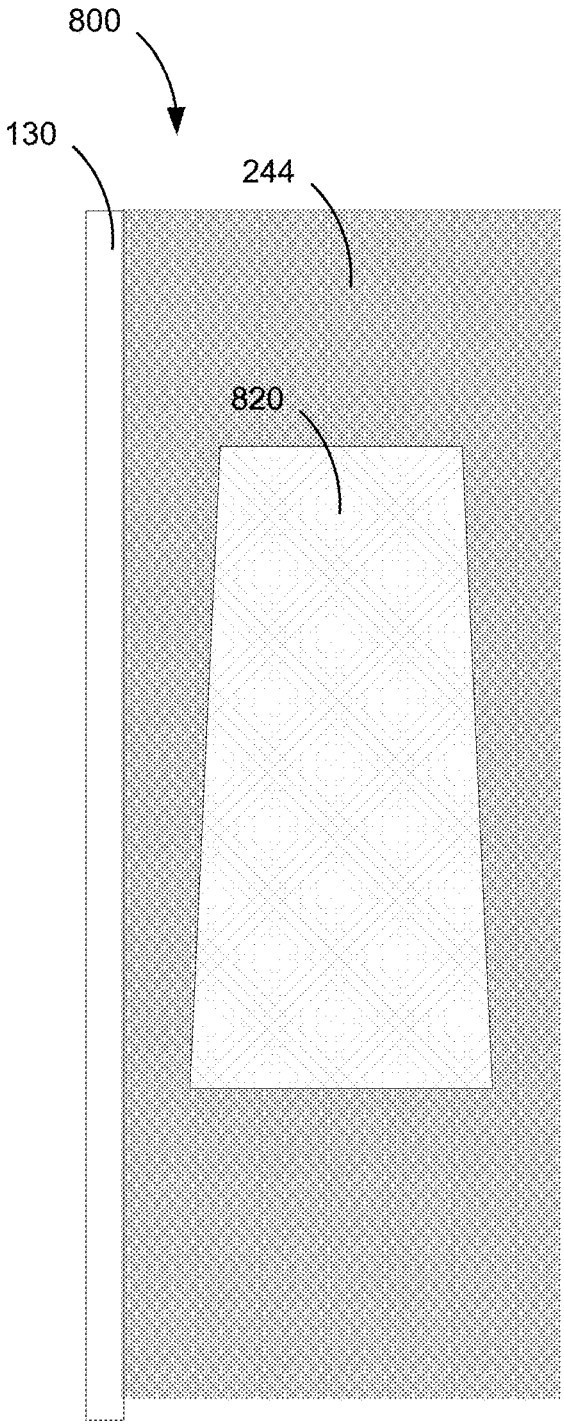
FIG. 20 illustrates a schematic representation of still another embodiment of a body of a dispenser assembly having multiple transparent and translucent portions.

In the embodiment described herein, the first and second windows 220, 224 are substantially identical and provided at opposite sides of the dispenser. However, in other embodiments, the first and second windows 220, 224, may be configured differently. Referring to FIGS. 18-20, alternative embodiments of the illuminating portion 244, representative of the sidewall 146 of the body 140, and the viewing portion 240, representative of one of the windows 220, 224, are depicted having varying sizes and shapes and in varying locations and arrangements.

Referring to FIG. 18, a schematic representation of a viewing portion 600 in the form of an array of window slits 620 is provided vertically along the illuminating portion 244. The window slits 620 are shown approximately equally spaced apart from each other and centrally positioned between the front end 160 and the rear end 158 of the sidewall 146, which constitutes the illuminating portion 244. As illustrated, the window slits 620 are each spaced apart from the front panel 130, which further expands the actuation viewing zone 250 in front of the dispenser 110 and narrows the assessment zones 260, 262. Further, the window slits 620 are each bordered on all sides by the illuminating portion 244. In addition the cartridge 120 and/or the fluid fill level 552 may be visible through all of the window slits 620 when the cartridge 120 is full, and progressively fewer of the window slits 620 as the cartridge 120 collapses and the fluid fill level 552 reduces during use. Markings may be provided on the sidewall 146 and/or the window slits 620 to correspond with well-known symbols of full and empty.

Referring to FIG. 19, a schematic representation of a viewing portion 700 in the form of an array of window slits 720 is provided along the illuminating portion 244. In the illustrated embodiment, window slits 720 are each bordered on all sides by the illuminating portion 244. The window slits 720 are differently sized and shaped, increasing in surface area in a downward direction to provide greater visibility when a cartridge 120, 520 and/or fluid fill level 552 nears the empty state and less visibility when the cartridge 120, 520 and/or fluid fill level 552 is full.

Referring to FIG. 20, a schematic representation of a viewing portion 800 in the form of a tapered window 820 is provided along the illuminating portion 244. Further, the tapered window 820 is bordered on all sides by the illuminating portion 244. The tapered window 820 is narrower toward the top end 162 and wider toward the bottom end 164, allowing for more visibility as the cartridge 120, 520 and/or fluid fill level 552 nears the empty state.

In some environments, a plurality of dispensers are located along a single wall. The dispenser 110 of the present disclosure is configured to allow for such a series of dispensers 110 to share one or more common assessment zones 260, 262 from which maintenance professionals can determine an amount of fluid remaining in multiple dispensers 110 simultaneously, which saves time and is more efficient.

Figure 21:
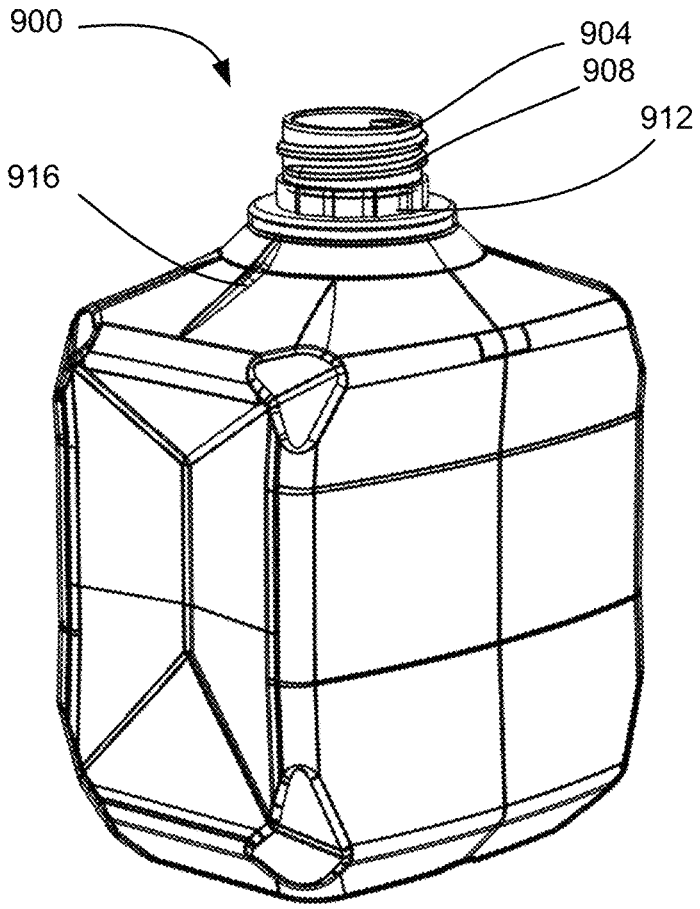
FIG. 21 illustrates a perspective view of yet another embodiment of a cartridge.

With reference to FIG. 21, an alternative cartridge 900 is shown, which is similar to the cartridge 120 described in relation to FIGS. 5-7, so only differences will be described below. In the embodiment of FIG. 21, the cartridge neck 904 is provided with a thread 908 such that it can be screwed onto any suitable dispensing mechanism for dispensing fluid from the cartridge 120. The neck 904 of cartridge 120 is provided with an anti-tamper feature in the form of a ratchet 912, which prevents unscrewing of a dispensing mechanism once it is attached to the cartridge 120. The support ribs 916 (opposite rib not shown) are similar to the support ribs 356 described in relation to cartridge 120, however, the support ribs 916 of cartridge 120 are thinner in width and have a lower profile such that, when more viscous fluids are used, the support ribs 916 do not trap fluid. It will be appreciated that in the cartridge 900 the support ribs 916 include a hollow structure that is open to the interior of the cartridge, although in some embodiments the support ribs 916 may be solid.

Although one or more preferred embodiments have been described, it will be appreciated that various changes or modifications may be made without departing from the scope defined in the appended claims.

The invention claimed is:

1. A cartridge, comprising:

a front wall, a rear wall, a pair of side walls, and a base that is opposite a neck;

a shoulder section that is located at an outlet end, the shoulder section extending at an angle from the neck to each of the front wall, the rear wall, and the pair of side walls;

an open mouth extending through the neck to an inner volume;

a vertical axis extending centrally through the cartridge; and a plurality of creases, wherein an upper crease and a lower crease each extend along the front wall and the rear wall perpendicular to the vertical axis and between the pair of side walls, wherein the upper crease is located a first distance from the shoulder section and the lower crease is located a second distance from the base, wherein the second distance is greater than the first distance, and wherein the upper and lower creases are arranged to be offset from an even spacing between the base and the shoulder section of the cartridge in a direction toward the outlet end.

2. The cartridge of claim 1, wherein the cartridge includes at least one opaque portion.

3. The cartridge of claim 1, wherein the cartridge includes at least one translucent portion.

4. The cartridge of claim 1, wherein a rib extends along the shoulder between the neck and one of the pair of side walls.

5. The cartridge of claim 1, wherein the plurality of creases define a collapse pattern and the cartridge is configured to collapse according to the collapse pattern.

6. A cartridge for use within a dispenser, the cartridge comprising:

an outlet end, a base end opposite the outlet end, a front wall, a rear wall, and two side walls, wherein the outlet end has a shoulder and an annular collar that extends about an axially extending neck that defines an opening into an inner volume of the cartridge, wherein the front, rear and two side walls extend from the outlet end to the base end, wherein the front wall and the rear wall include a plurality of fold lines that are arranged to be offset from an even spacing between the base end and the shoulder of the cartridge in a direction toward the outlet end, wherein a vertical plane is disposed centrally between the two side walls and intersects the front wall and the rear wall, wherein the two side walls include a first side wall and a second side wall each carrying a respective first and second valley, wherein each of the first valley and the second valley is bordered by a top peripheral edge, a front peripheral edge, a rear peripheral edge, and a bottom peripheral edge, wherein a front panel extends from the front peripheral edge toward a vertical fold line, a rear panel extends from the rear peripheral edge to the vertical fold line, an upper panel extends from the top peripheral edge to the vertical fold line, and a lower panel extends from the bottom peripheral edge to the vertical fold line, wherein the vertical fold line is located closer to the vertical plane than the top, front, rear, and bottom peripheral edges, wherein the vertical fold line extends between an upper junction and a lower junction, the upper junction being connected to an upper pair of angled fold lines and the lower junction being connected to a lower pair of angled fold lines, wherein the upper panel extends between the upper pair of angled fold lines, the lower panel extends between the lower pair of angled fold lines, and wherein the upper panel defines a surface area that is less than a surface area of the lower panel, and wherein the upper junction is located closer to the top peripheral edge than the lower junction is located to the bottom peripheral edge.

7. The cartridge of claim 6, wherein each of the upper panel and the lower panel is substantially triangular-shaped and has a substantially planar surface.

8. The cartridge of claim 6, wherein on collapsing of the cartridge under a vacuum applied to withdraw fluid from the opening, the front wall and rear wall are drawn toward each other, and the first side wall and the second side wall fold along respective upper and lower pairs of fold lines and vertical fold lines.

9. A cartridge, comprising:

an inner volume;

a neck extending from a shoulder portion at an outlet end;

a front wall opposite a rear wall and a first wall opposite a second wall; and a base, wherein the front wall and the rear wall include a plurality of creases that are arranged to be offset from an even spacing between the base and shoulder portion of the cartridge in a direction toward the outlet end, wherein the neck defines an opening that is in communication with the inner volume, and wherein the cartridge is configured to be inserted into a dispenser having a front panel that is opaque and a body that includes at least two visible light transmission (VLT) values, each of the VLT values being greater than 5%.

10. The cartridge of claim 9, wherein the cartridge has a VLT value greater than 5%.

11. The cartridge of claim 9, wherein when the cartridge is inserted into the dispenser a first portion of the cartridge is configured to be visible through a viewing portion having a VLT value greater than 5% and a second portion of the cartridge is configured to be hidden from view through the viewing portion.

12. The cartridge of claim 9, wherein a label is affixed to at least one of the front wall and the rear wall, the label being configured to be hidden from view when the cartridge is inserted into the dispenser.

13. The cartridge of claim 9, wherein the cartridge is configured to be received by the dispenser in an inverted orientation.

14. The cartridge of claim 9, wherein the cartridge is configured to contain a fluid within the inner volume and the fluid is configured to be visible when the cartridge is inserted into the dispenser.

* * * * *